US012630998B2

(12) United States Patent
Narikawa et al.

(10) Patent No.: US 12,630,998 B2
(45) Date of Patent: May 19, 2026

(54) WORK VEHICLE

(71) Applicant: HITACHI CONSTRUCTION MACHINERY CO., LTD., Tokyo (JP)

(72) Inventors: Ryu Narikawa, Mito (JP); Teppei Saitoh, Mito (JP); Tadashi Kotani, Kashiwa (JP); Hideaki Ito, Katori (JP); Kei Sato, Tsuchiura (JP); Hidefumi Ishimoto, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 18/845,496

(22) PCT Filed: Mar. 27, 2023

(86) PCT No.: PCT/JP2023/012298
§ 371 (c)(1),
(2) Date: Sep. 10, 2024

(87) PCT Pub. No.: WO2023/190388
PCT Pub. Date: Oct. 5, 2023

(65) Prior Publication Data

US 2025/0207353 A1 Jun. 26, 2025

(30) Foreign Application Priority Data

Mar. 31, 2022 (JP) ..... 2022-060395

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 9/123* (2013.01); *E02F 9/2033* (2013.01);
(Continued)

(58) Field of Classification Search
None
See application file for complete search history.

(56) References Cited

U.S. PATENT DOCUMENTS 9,187,879 B2 * 11/2015 Suk ..... E02F 3/434
10,273,124 B2 * 4/2019 Rutherford ..... B66C 1/585
(Continued)

FOREIGN PATENT DOCUMENTS

JP 11-34719 A 2/1999
JP 2016-089389 A 5/2016
(Continued)

OTHER PUBLICATIONS

International Search Report of PCT/JP2023/012298 dated May 16, 2023.
(Continued)

*Primary Examiner* — Jonathan M Dager
(74) *Attorney, Agent, or Firm* — MATTINGLY & MALUR, PC

(57) ABSTRACT

A work machine controller is configured to, when in a swinging operation, identify a circumferential operation start position of the tip of an arm based on a detected posture of the work device, and identify an angular interference prevention position in a swing direction that does not interfere between a vessel being loaded and the work device. A lower limit value of a height direction of the work device corresponding to the angular position in the swing direction of the arm is calculated to be within an operating range of the swing body from the identified operation start position to the interference prevention position. While the swinging body is in motion, the controller invalidates the operation of the arm and controls the movement of the boom and the swinging body so that the height of the tip of the arm does not fall below the lower limit value.

5 Claims, 24 Drawing Sheets

(51) Int. Cl.

| | |
|---|---|
| ***E02F 9/12*** | (2006.01) |
| ***E02F 9/20*** | (2006.01) |
| ***E02F 9/24*** | (2006.01) |
| ***E02F 9/26*** | (2006.01) |
| *E02F 9/22* | (2006.01) |

(52) U.S. Cl.
CPC ..... *E02F 9/2037* (2013.01); *E02F 9/24* (2013.01); *E02F 9/262* (2013.01); *E02F 9/265* (2013.01); *E02F 9/2203* (2013.01); *E02F 9/2285* (2013.01); *E02F 9/2292* (2013.01)

(56) References Cited

U.S. PATENT DOCUMENTS 11,242,233 B2 * 2/2022 Nedjimi ..... B66F 9/0755
11,248,365 B2 * 2/2022 Asada ..... E02F 9/205
11,788,254 B2 * 10/2023 Aizawa ..... E02F 9/2296 701/50
11,966,220 B2 * 4/2024 Kean ..... G05D 1/227
12,291,839 B2 * 5/2025 Takeda ..... E02F 9/2228
12,338,601 B2 * 6/2025 Wu ..... E02F 3/439
12,428,804 B2 * 9/2025 Nishi ..... E02F 9/2033
2005/0000703 A1 * 1/2005 Furuno ..... G01G 19/08 172/2
2008/0263908 A1 * 10/2008 Schoenmaker ..... E02F 9/2041 711/100
2009/0218112 A1 * 9/2009 Mintah ..... E02F 3/437 701/50
2012/0130599 A1 * 5/2012 Faivre ..... E02F 9/265 701/50
2012/0191431 A1 * 7/2012 Dunbabin ..... E02F 9/2029 703/6
2012/0263566 A1 * 10/2012 Taylor ..... E02F 3/54 701/50
2014/0257647 A1 * 9/2014 Wu ..... E02F 9/24 701/50
2014/0338235 A1 * 11/2014 Ryan ..... E02F 3/435 701/50
2017/0073935 A1 * 3/2017 Friend ..... E02F 9/265
2018/0080193 A1 * 3/2018 Myers ..... E02F 9/262
2018/0119384 A1 * 5/2018 Imaizumi ..... E02F 9/265
2018/0142441 A1 * 5/2018 Berry ..... E02F 3/434
2018/0178342 A1 * 6/2018 Russell ..... G01C 9/04
2018/0266071 A1 * 9/2018 Matsuyama ..... E02F 9/2004
2018/0305902 A1 * 10/2018 Tsukamoto ..... E02F 3/439
2019/0093311 A1 * 3/2019 Naito ..... B60Q 9/008
2020/0011029 A1 * 1/2020 Sano ..... E02F 9/265
2020/0199853 A1 * 6/2020 Konda ..... E02F 9/205
2020/0224385 A1 * 7/2020 Saigo ..... E02F 3/439
2020/0248434 A1 * 8/2020 Konda ..... E02F 9/2033
2020/0299929 A1 * 9/2020 Ohiwa ..... E02F 9/123
2021/0246625 A1 * 8/2021 Oi ..... E02F 9/265
2021/0262191 A1 * 8/2021 Ito ..... E02F 9/205
2021/0272315 A1 * 9/2021 Kawamoto ..... E02F 9/261
2021/0292998 A1 * 9/2021 Kawamoto ..... E02F 9/261
2023/0193588 A1 * 6/2023 Hatake ..... E02F 3/439 701/50
2024/0368856 A1 * 11/2024 Hino ..... E02F 9/2033
2025/0043541 A1 * 2/2025 Ainapure ..... E02F 9/262

FOREIGN PATENT DOCUMENTS

JP 2019-065661 A 4/2019
JP 2020-033825 A 3/2020
JP 2021-050474 A 4/2021

OTHER PUBLICATIONS

International Preliminary Report on Patentability received in corresponding International Application No. PCT/JP2023/012298 dated Oct. 10, 2024.

* cited by examiner

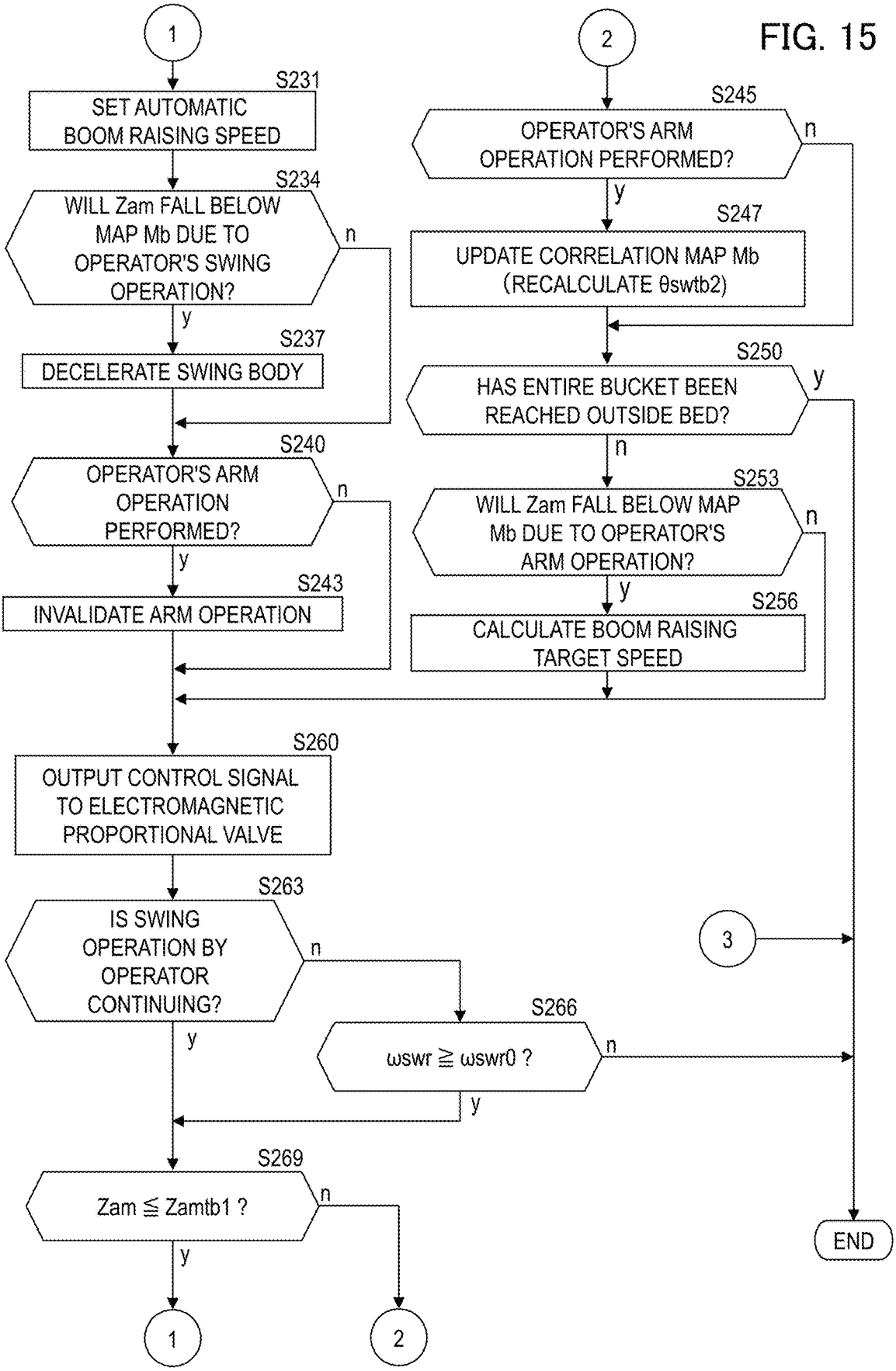
FIG. 15
1
S231
SET AUTOMATIC BOOM RAISING SPEED
S234
WILL Zam FALL BELOW MAP Mb DUE TO OPERATOR'S SWING OPERATION?
n
y
S237
DECELERATE SWING BODY
S240
OPERATOR'S ARM OPERATION PERFORMED?
n
y
S243
INVALIDATE ARM OPERATION
S260
OUTPUT CONTROL SIGNAL TO ELECTROMAGNETIC PROPORTIONAL VALVE
S263
IS SWING OPERATION BY OPERATOR CONTINUING?
n
y
S266
ωswr ≧ ωswr0 ?
n
y
S269
Zam ≦ Zamtb1 ?
n
y
1
2
2
S245
OPERATOR'S ARM OPERATION PERFORMED?
n
y
S247
UPDATE CORRELATION MAP Mb (RECALCULATE θswtb2)
S250
HAS ENTIRE BUCKET BEEN REACHED OUTSIDE BED?
y
n
S253
WILL Zam FALL BELOW MAP Mb DUE TO OPERATOR'S ARM OPERATION?
n
y
S256
CALCULATE BOOM RAISING TARGET SPEED
3
END

WORK VEHICLE

TECHNICAL FIELD

The present invention relates to a work machine.

BACKGROUND ART

Work machines, such as hydraulic excavators, are known, which are equipped with a swing body that is rotatably mounted on a track body, and a multi-jointed work device mounted on the swing body. The work device provided on such hydraulic excavators includes a boom that is rotatably mounted on the swing body, an arm that is rotatably mounted on the boom, and a bucket that is rotatably mounted on the arm.

A hydraulic excavator performs the operations of hauling the excavated materials such as earth and sand, which have been excavated by the work device, up to above the loading bed (vessel) of a to-be-loaded machine such as a dump truck, and the operation of discharging the excavated materials onto the loading bed of the dump truck, thereby carrying out the loading work of the excavated materials.

When performing the loading work, if the position of the bucket is too low relative to the dump truck, there is a risk that the bucket may interfere with the dump truck during the hauling operation. On the other hand, if the bucket releases from an excessively high position relative to the dump truck, there is a risk that the released excavated materials may damage the dump truck. Therefore, when performing the loading work, the operator of the hydraulic excavator needs to coordinate the movement of the swing body and the work device while checking the position of the dump truck, and proficiency is required for the operation. Also, after the releasing operation, it is necessary to avoid interference between the bucket and the dump truck while preparing to move the work device towards the excavation target for the next excavation operation.

Patent Document 1 discloses a hydraulic excavator equipped with a controller capable of executing control to prevent the bucket from contacting the dump truck by the rotation of the swing body. The controller of the hydraulic excavator described in Patent Document 1 specifies the release position based on the position information and orientation information of the dump truck, and specifies the interference avoidance position based on the specified release position. The controller described in Patent Document 1 specifies the interference avoidance position, which is at the same height as the release position (discharge position) and at a distance from the center of rotation of the swing body equal to the distance from the center of rotation to the release position, and where the dump truck is not present below the bucket, and generates an operation signal to drive only the swing body after the bucket reaches the interference avoidance position.

PRIOR ART DOCUMENTS

Patent Document

Patent Document 1: JP 2019-65661

SUMMARY OF THE INVENTION

Problem to be Solved by the Invention

The operator of a hydraulic excavator may adjust the posture of the work device when the bucket is near the bed.

For example, in loading work, the suitable position for releasing excavated materials from the bucket to the dump truck varies depending on the condition of the excavated materials released onto the dump truck. Therefore, in loading work, after the bucket is positioned above the dump truck, the operator of the hydraulic excavator may adjust the posture of the work device so that the bucket reaches the desired release position.

However, the controller of the hydraulic excavator described in Patent Document 1 operates only the swing body when moving the bucket from the interference avoidance position to the release position. The technology described in Patent Document 1 does not allow for the adjustment of the release position by operating the work device according to the operator's intention after the bucket has approached the bed of the dump truck, which may cause discomfort to the operator.

The present invention relates to a work machine that, in operations such as loading, can prevent interference between the work device and the vessel of the to-be-loaded machine, and aims to provide a work machine that can adjust the posture of the work device after it has approached the side part of the vessel, reflecting the operator's intention.

Means for Solving the Problem

A work machine according to an aspect of the present invention includes: a track body; a swing body provided so as to be able to swing relative to the track body; a work device attached to the swing body and having a boom, an arm, and a bucket; a posture detection device for detecting a posture of the work device; a vessel position acquisition device for acquiring a position of the vessel of a to-be-loaded machine with excavated material by the work device; an arm operation device for operating the arm; a swing operation device for operating the swing body; and a controller for controlling an operation of the work device and the swing body, and loads an excavated object into the vessel, which has a bottom and a plurality of side parts and whose top is open. The controller calculates an interference prevention height, which is a height of a tip of the arm at which the work device does not interfere with the vessel, based on the position of the vessel acquired by the vessel position acquisition device. The controller determines whether an interference prevention control execution condition, including a swing operation towards a direction in which the bucket approaches the side part of the vessel, has been met. The controller, if it is determined that the interference prevention control execution condition has been met, based on the posture of the work device detected by the posture detection device, identifies an operation start position, which is a circumferential position of the tip of the arm when the interference prevention control execution condition has been met. The controller identifies the interference prevention position, which is an angular position in a swing direction of the tip of the arm that does not interfere with the vessel and the work device between the operation start position and the side part of the vessel. The controller calculates a lower limit of a height direction of the work device corresponding to the angular position in the swing direction of the tip of the arm, which becomes larger as it approaches the interference prevention position and becomes the interference prevention height at the interference prevention position, from the identified operation start position to the interference prevention position within an operating range of the swing body. The controller, during the operation of the swing body from the operation start position to the interference prevention position, disables the operation of the arm by the arm operation device and controls the operation of the boom and the swing body so that the height of the tip of the arm does not fall below the lower limit. The controller determines whether an activation condition for the operation of the arm, including the condition that the tip of the arm has reached a height exceeding the interference prevention height and has reached a swing direction angle position beyond the interference prevention position, has been met. The controller, if the activation condition has been met, enables the operation of the arm by the arm operation device. The controller determines whether the bucket has passed the side part of the vessel in plan view after swinging beyond the interference prevention position. The controller, if it is not determined that the bucket has passed the side part of the vessel, controls the operation of at least one of the boom and the arm so that the height of the tip of the arm operated in accordance with the operation of the arm by the arm operation device does not fall below the interference prevention height. The controller, if it is determined that the bucket has passed the side part of the vessel, allows the operation of the tip of the arm to a position lower than the interference prevention height.

Advantages of the Invention

According to the present invention, there is provided a work machine capable of preventing interference between the work device and the vessel of the machine to be loaded, such as in loading operations, and capable of adjusting the posture of the work device after the work device has approached the side part of the vessel, reflecting the operator's intention.

BRIEF DESCRIPTION OF THE DRAWINGS

FIG. 15 is a flowchart showing an example of the process flow of preparation operation support control executed by the controller according to the second embodiment, showing the processes from step S231 to S269.

MODES FOR CARRYING OUT THE INVENTION

Figure 1:
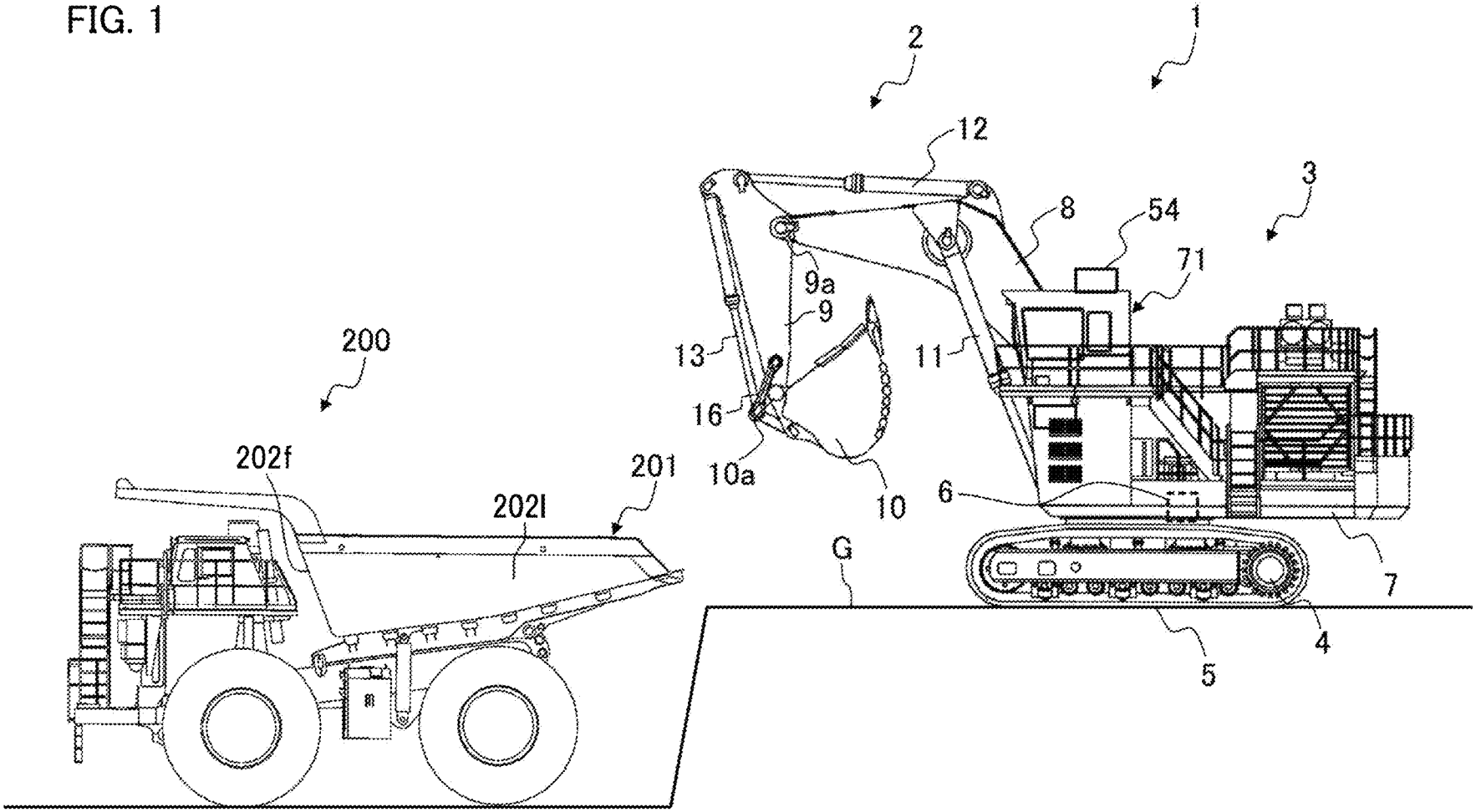
FIG. 1 is a side view of a hydraulic excavator according to a first embodiment.

Hereinafter, embodiments of the present invention will be described with reference to the drawings. It should be noted that, in the following description, when the same component exists in plurality, an alphabet letter may be appended to the end of the reference numeral to distinguish them, but the plurality of components may be collectively referred to without the alphabet letter. For example, when there are two identical travel hydraulic motors 4*a*, 4*b*, they may collectively be referred to as travel hydraulic motor 4. Furthermore, in the following description, control executed by a controller to support loading operations in response to operator's operations is referred to as "loading operation support control." Also, control executed by a controller to support preparatory operations in response to operator's operations is referred to as "preparatory operation support control."

First Embodiment

FIG. 1 is a side view of a hydraulic excavator 1 according to a first embodiment of the present invention. As shown in FIG. 1, the hydraulic excavator 1 according to the present embodiment is a backhoe excavator with a bucket 10 attached to the tip of an arm 9 in a backward direction. The hydraulic excavator 1 performs excavation work to excavate a target surface such as the ground, and loading work to load the excavated material into the bed 201 of a loading machine 200 such as a dump truck.

In the loading work, the hydraulic excavator 1 performs a hauling operation to haul the excavated material in the bucket 10 to above the to-be-loaded machine 200 by swinging the upper swing body 7, and a discharging operation to discharge the excavated material into the bed 201 of the to-be-loaded machine 200. The bed 201 is an open-top vessel (tray) having a pair of side parts 202*l*, 202*r* on the left and right sides (see FIG. 8), a front side part 202*f*, and a bottom part 203 connecting these multiple side parts 202*l*, 202*r*, 202*f* (see FIG. 8). The left side part 202*l* and the right side part 202*r* are arranged facing each other.

The hydraulic excavator 1 includes a machine body (main body) 3 and a multi-jointed work device 2 attached to the machine body 3. The machine body 3 includes a lower track body 5 and an upper swing body 7 provided to be rotatable relative to the lower track body 5. The lower track body 5 travels with a right crawler drive hydraulic motor 4*a* for driving the right crawler (see FIG. 2) and a left crawler drive hydraulic motor 4*b* for driving the left crawler (see FIG. 2). The upper swing body 7 is attached to the top of the lower track body 5 via a swing device and swings with a swing hydraulic motor 6 of the swing device. In this embodiment, the right crawler drive hydraulic motor 4*a* and the left crawler drive hydraulic motor 4*b* are collectively referred to as travel hydraulic motor 4.

The work device 2 has multiple drivable members (8,9, 10) connected to be rotatable and multiple hydraulic cylinders (11,12,13) for driving the drivable members. In this embodiment, a boom 8, an arm 9, and a bucket 10, which are three drive target members driven by a plurality of hydraulic cylinders (11,12,13), are serially connected.

Figure 4:
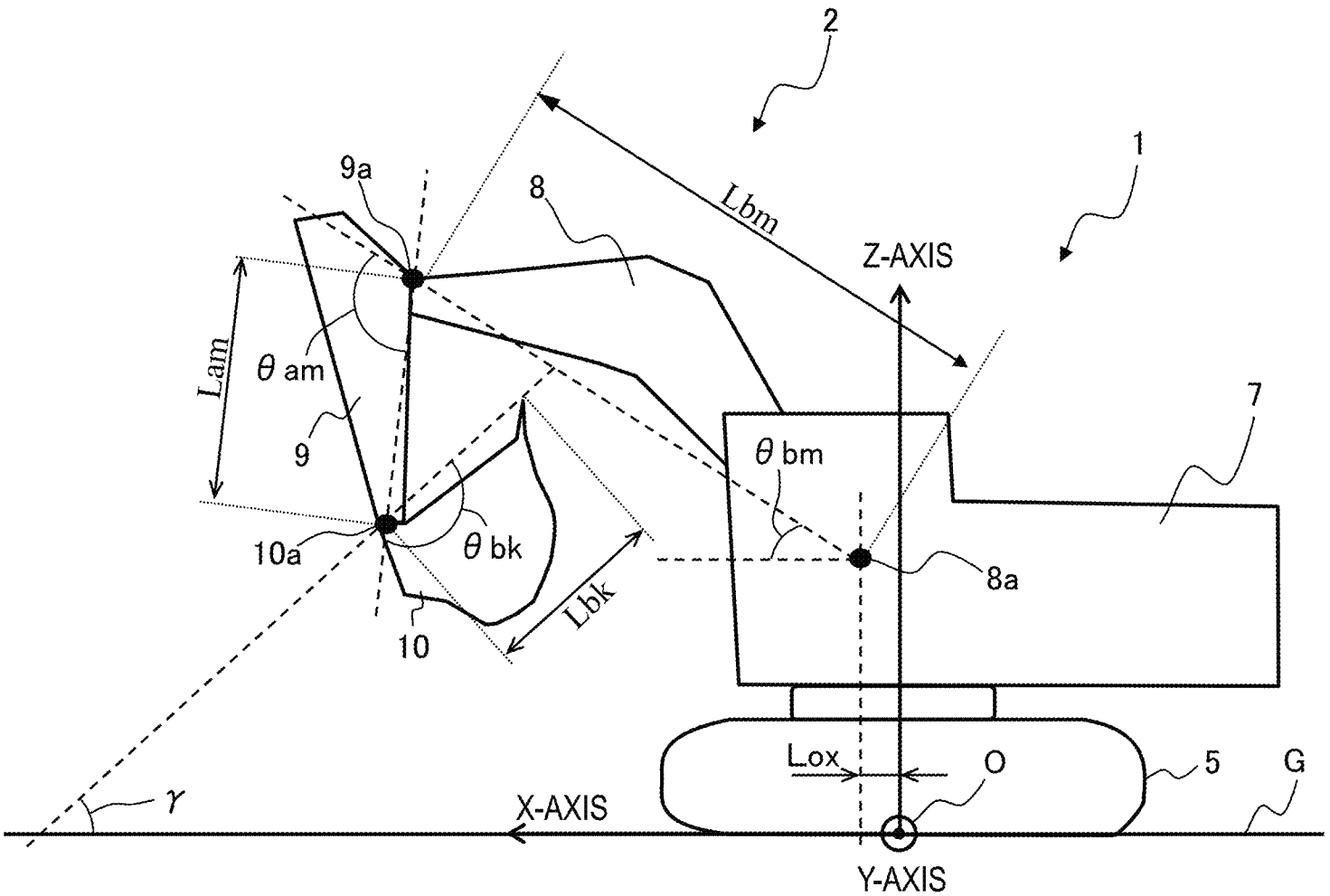
FIG. 4 is a diagram showing the excavator reference coordinate system viewed from the Y-axis direction.

The boom 8 is rotatably connected at its base end to the front part of the upper swing body 7 by a boom pin 8*a* (refer to FIG. 4). The arm 9 is rotatably connected at its base end to the tip end of the boom 8 by an arm pin 9*a*. The bucket 10 is rotatably connected at the tip end of the arm 9 by a bucket pin 10*a*. The boom pin 8*a*, arm pin 9*a*, and bucket pin 10*a* are arranged parallel to each other, and each drive target member (8,9,10) is capable of relative rotation within the same plane.

The boom 8 rotates in the vertical direction by the telescopic operation of the boom cylinder 11. The arm 9 rotates in the forward and backward direction (dump direction and crowd direction) by the telescopic operation of the arm cylinder 12. The bucket 10 rotates in the forward and backward direction (dump direction and crowd direction) by the telescopic operation of the bucket cylinder 13. The boom cylinder 11 is connected at one end to the boom 8 and at the other end to the frame of the upper swing body 7. The arm cylinder 12 is connected at one end to the arm 9 and at the other end to the boom 8. The bucket cylinder 13 is connected at one end to the bucket 10 through a bucket link 16 and at the other end to the arm 9.

Figure 2:
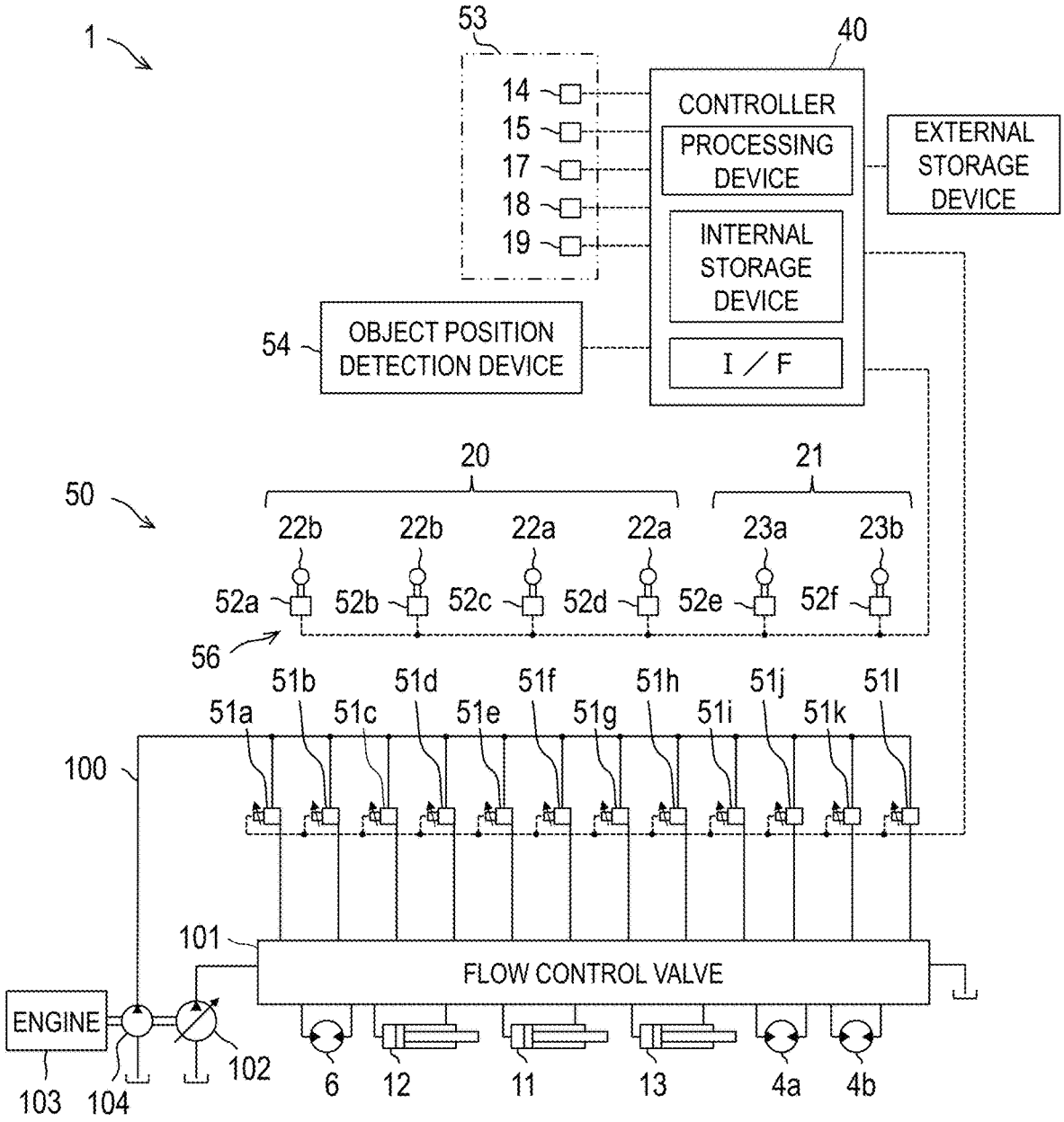
FIG. 2 is a schematic configuration diagram of the hydraulic drive system of the hydraulic excavator.

FIG. 2 is a schematic configuration diagram of the hydraulic drive system 50 of the hydraulic excavator 1. As shown in FIG. 2, the hydraulic drive system 50 includes an engine 103, which is a prime mover mounted on the upper swing body 7, and a main pump 102 and a pilot pump 104, which are hydraulic pumps driven by the engine 103. The main pump 102 and the pilot pump 104 are driven by the engine 103 to discharge hydraulic oil.

The hydraulic drive system 50 includes: a flow control valve 101 that controls the flow rate and flow direction of the hydraulic oil discharged from the main pump 102; multiple electromagnetic proportional valves 51 that output an operation pressure as an operation signal to the flow control valve 101; a controller 40 that outputs a control signal to the electromagnetic proportional valves 51; and operation devices 20,21 that are operated by the operator to output signals corresponding to the operation amount and operation direction to the controller 40. The operation devices 20,21 are installed within the cab 71 (refer to FIG. 1) provided on the upper swing body 7.

The operation device 20 for work includes a work operation right lever 22*a* for operating the boom 8 and the bucket 10, and a work operation left lever 22*b* for operating the arm 9 and the upper swing body 7. That is, the operation device 20 has functions as a boom operation device, a bucket operation device, an arm operation device, and a swing operation device. The operation device 21 for travel includes a travel operation right lever 23*a* for operating the right crawler and a travel operation left lever 23*b* for operating the left crawler. In this embodiment, the work operation right lever 22*a* and the work operation left lever 22*b* are collectively referred to as operation lever 22, and the travel operation right lever 23*a* and the travel operation left lever 23*b* are collectively referred to as operation lever 23.

The operation system according to this embodiment is an electric lever type operation system in which an electrical signal representing the operation amount and operation direction is input from the operation device 20 to the controller 40, a control signal is output from the controller 40 to the electromagnetic proportional valve 51, and the operating pressure is output from the electromagnetic proportional valve 51 to the flow control valve 101.

The hydraulic excavator 1 includes an operation detection device 56 that detects the operation amount and operation direction of operation levers 22, 23 and outputs a signal representing the detection result to the controller 40. The operation detection device 56 includes: an operation amount sensor 52*a* that detects the arm crowd operation amount and arm dump operation amount by the work operation left lever 22*b*; an operation amount sensor 52*b* that detects the right swing operation amount and left swing operation amount by the work operation left lever 22*b*; an operation amount sensor 52*c* that detects the boom raise operation amount and boom lower operation amount by the work operation right lever 22*a*; an operation amount sensor 52*d* that detects the bucket crowd operation amount and bucket dump operation amount by the work operation right lever 22*a*; an operation amount sensor 52*e* that detects the right crawler forward operation amount and right crawler reverse operation amount by the travel operation right lever 23*a*; and an operation amount sensor 52*f* that detects the left crawler forward operation amount and left crawler reverse operation amount by the travel operation left lever 23*b*.

The plurality of operation amount sensors 52 are, for example, rotary encoders or potentiometers capable of detecting the operation amount and operation direction of operation levers 22, 23.

The controller 40 according to this embodiment controls the rotational movement of the work device 2, the travel movement of the lower track body 5, and the swing movement of the upper swing body 7 in accordance with the operation information (operation amount and operation direction) of the operation levers 22, 23 by the operator.

Specifically, the controller 40 outputs a control signal corresponding to the operation amount and operation direction of the operation levers 22, 23 by the operator to the electromagnetic proportional valves 51 (51*a* to 51*l*). The electromagnetic proportional valve 51 is provided in the pilot line 100 to which pressure oil is supplied from the pilot pump 104. When a control signal from the controller 40 is input, the electromagnetic proportional valve 51 operates, reducing the primary pressure in the pilot line 100 to generate a secondary pressure, which is output as operating pressure to the flow control valve 101. The flow control valve 101 has a plurality of spool valves provided for each of the plurality of hydraulic actuators (swing hydraulic motor 6, arm cylinder 12, boom cylinder 11, bucket cylinder 13, travel hydraulic motor 4*a*, and travel hydraulic motor 4*b*). The operating pressure output by the electromagnetic proportional valve 51 is led to the pressure chamber of the spool valve, causing the spool to operate. As a result, the hydraulic oil discharged from the main pump 102 is supplied to the corresponding hydraulic actuator through the spool valve, operating the hydraulic actuator.

The electromagnetic proportional valves 51*a*, 51*b* output the operating pressure for controlling the pressure oil supplied to the swing hydraulic motor 6 to the pressure chamber of the spool valve for driving the swing hydraulic motor 6 of the flow control valve 101. The electromagnetic proportional valves 51*c*, 51*d* output the operating pressure for controlling the pressure oil supplied to the arm cylinder 12 to the pressure chamber of the spool valve for driving the arm cylinder 12 of the flow control valve 101. The electromagnetic proportional valves 51*e*, 51*f* output the operating pressure for controlling the pressure oil supplied to the boom cylinder 11 to the pressure chamber of the spool valve for driving the boom cylinder 11 of the flow control valve 101. Electromagnetic proportional valves 51*g*, 51*h* output an operating pressure for controlling the pressure oil supplied to the bucket cylinder 13 to the pressure chamber of the spool valve for driving the bucket cylinder 13 of the flow control valve 101. Electromagnetic proportional valves 51*i*, 51*j* output an operating pressure for controlling the pressure oil supplied to the travel hydraulic motor 4*a* to the pressure chamber of the spool valve for driving the travel hydraulic motor 4*a* of the flow control valve 101. Electromagnetic proportional valves 51*k*, 51*l* output an operating pressure for controlling the pressure oil supplied to the travel hydraulic motor 4*b* to the pressure chamber of the spool valve for driving the travel hydraulic motor 4*b* of the flow control valve 101.

The boom cylinder 11, the arm cylinder 12, and the bucket cylinder 13 extend and retract by the supplied pressure oil, thereby rotating the boom 8, the arm 9, and the bucket 10, resulting in a change in the position of the bucket 10 and the posture of the work device 2. The swing hydraulic motor 6 rotates by the supplied pressure oil, swinging the upper swing body 7. The travel hydraulic motors 4*a* and 4*b* rotate by the supplied pressure oil, causing the lower track body 5 to travel. Even in the absence of operator lever operations 22, 23, it is possible to drive the hydraulic actuators (4*a*, 4*b*, 6, 11, 12, 13) by operating the electromagnetic proportional valves 51*a* to 51*l* and the flow control valve 101 based on control signals from the controller 40.

The hydraulic excavator 1 is equipped with a posture detection device 53 for detecting the posture of the work device 2 and the machine body 3. The posture detection device 53 comprises multiple posture sensors, including a boom angle sensor 14, an arm angle sensor 15, a bucket angle sensor 17, an inclination angle sensor 18, and a swing angle sensor 19. The boom angle sensor 14, mounted on the boom pin 8*a*, detects the rotational angle of the boom 8 relative to the upper swing body 7 and outputs a signal representing the detection result to the controller 40. The arm angle sensor 15, mounted on the arm pin 9*a*, detects the rotational angle of the arm 9 relative to the boom 8 and outputs a signal representing the detection result to the controller 40. The bucket angle sensor 17, mounted on the bucket link 16, detects the rotational angle of the bucket 10 relative to the arm 9 and outputs a signal representing the detection result to the controller 40. The controller 40 acquires the rotational angles of the boom 8, the arm 9, and the bucket 10 from each angle sensor 14, 15, 17.

The method for acquiring the rotational angles of the boom 8, the arm 9, and the bucket 10 is not limited to this. The controller 40 may detect the angles of the boom 8, the arm 9, and the bucket 10 relative to a reference plane such as a horizontal plane using an Inertial Measurement Unit (IMU) and convert them into the respective rotational angles. Additionally, the controller 40 may detect the strokes of the boom cylinder 11, the arm cylinder 12, and the bucket cylinder 13 using stroke sensors and convert them into the respective rotational angles.

The inclination angle sensor 18, mounted on the upper swing body 7, detects the inclination angle of the upper swing body 7 (the machine body 3) relative to a reference plane such as a horizontal plane and outputs a signal representing the detection result to the controller 40. The swing angle sensor 19 is mounted on the swing device between the lower track body 5 and the upper swing body 7, detects the swing angle of the upper swing body 7 relative to the lower track body 5, and outputs a signal representing the detection result to the controller 40.

Here, the respective rotation angles of the boom 8, arm 9, and bucket 10 are parameters representing the posture of the work device 2. That is, the boom angle sensor 14, arm angle sensor 15, and bucket angle sensor 17 function as posture sensors for detecting the posture of the work device 2. Furthermore, the inclination angle of the upper swing body 7 and the swing angle of the upper swing body 7 relative to the lower track body 5 are parameters representing the posture of the upper swing body 7 (the machine body 3). That is, the inclination angle sensor 18 and the swing angle sensor 19 function as posture sensors for detecting the posture of the upper swing body 7 (the machine body 3).

The hydraulic excavator 1 is equipped with an object position detection device 54 for detecting the type and position of objects existing around the hydraulic excavator 1. The object position detection device 54, for example, LiDAR (Light Detection And Ranging) or a stereo camera, is mounted on the upper part of the cab 71. The object position detection device 54 detects the bed (vessel) 201 of the to-be-loaded machine 200 onto which the excavated material excavated by the work device 2 is loaded, as well as the relative position of the bed 201 of the to-be-loaded machine 200 to the object position detection device 54 provided on the upper swing body 7. The object position detection device 54 may be mounted in plurality on the hydraulic excavator 1.

The controller 40 is a computer in which processing devices such as CPU (Central Processing Unit), MPU (Micro Processing Unit), DSP (Digital Signal Processor), internal storage devices such as RAM (Random Access Memory), ROM (Read Only Memory), and an external I/F (Interface) are interconnected by a bus. The external I/F of the controller 40 is connected to an operation detection device 56, a posture detection device 53, an object position detection device 54, and external storage devices such as a hard disk drive or a large-capacity flash memory (not shown).

The ROM stores programs capable of performing various calculations. That is, the ROM is a readable storage medium that stores programs for realizing the functions of this embodiment. The processing device is an arithmetic device that expands the program stored in the ROM into the RAM for arithmetic execution and performs predetermined arithmetic processing on signals taken from the external I/F and storage devices (internal storage devices and external storage devices) in accordance with the program.

The input part of the external I/F converts signals input from various devices (operation detection device 56, posture detection device 53, object position detection device 54, etc.) into a form that can be calculated by the processing device. Furthermore, the output part of the external I/F generates output signals according to the calculation results of the processing device and outputs those signals to various devices (electromagnetic proportional valve 51, etc.).

The posture detection device 53 is composed of posture sensors (14,15,17) for detecting the posture of the work device 2 mentioned above, and posture sensors (18,19) for detecting the posture of the upper swing body 7 (the machine body 3).

Figure 3:
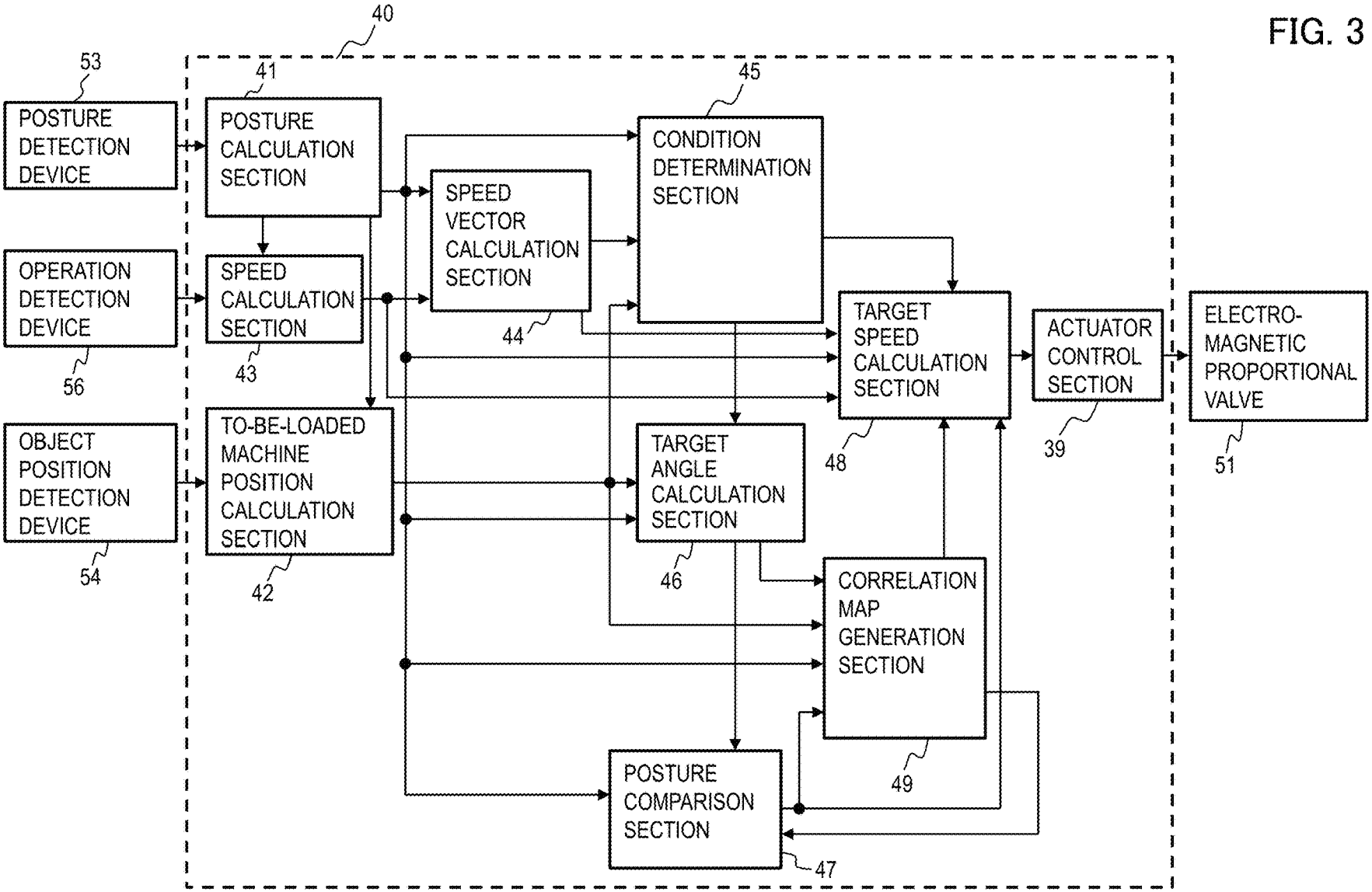
FIG. 3 is a functional block diagram of the controller according to the first embodiment.

FIG. 3 is a functional block diagram of the controller 40. As illustrated in FIG. 3, the controller 40 functions as a posture calculation section 41, a to-be-loaded machine position calculation section 42 to be loaded, a speed calculation section 43, a speed vector calculation section 44, a condition determination section 45, a target angle calculation section 46, a posture comparison section 47, a target speed calculation section 48, a correlation map generation section 49, and an actuator control section 39, by executing a program stored in the ROM.

Figure 5:
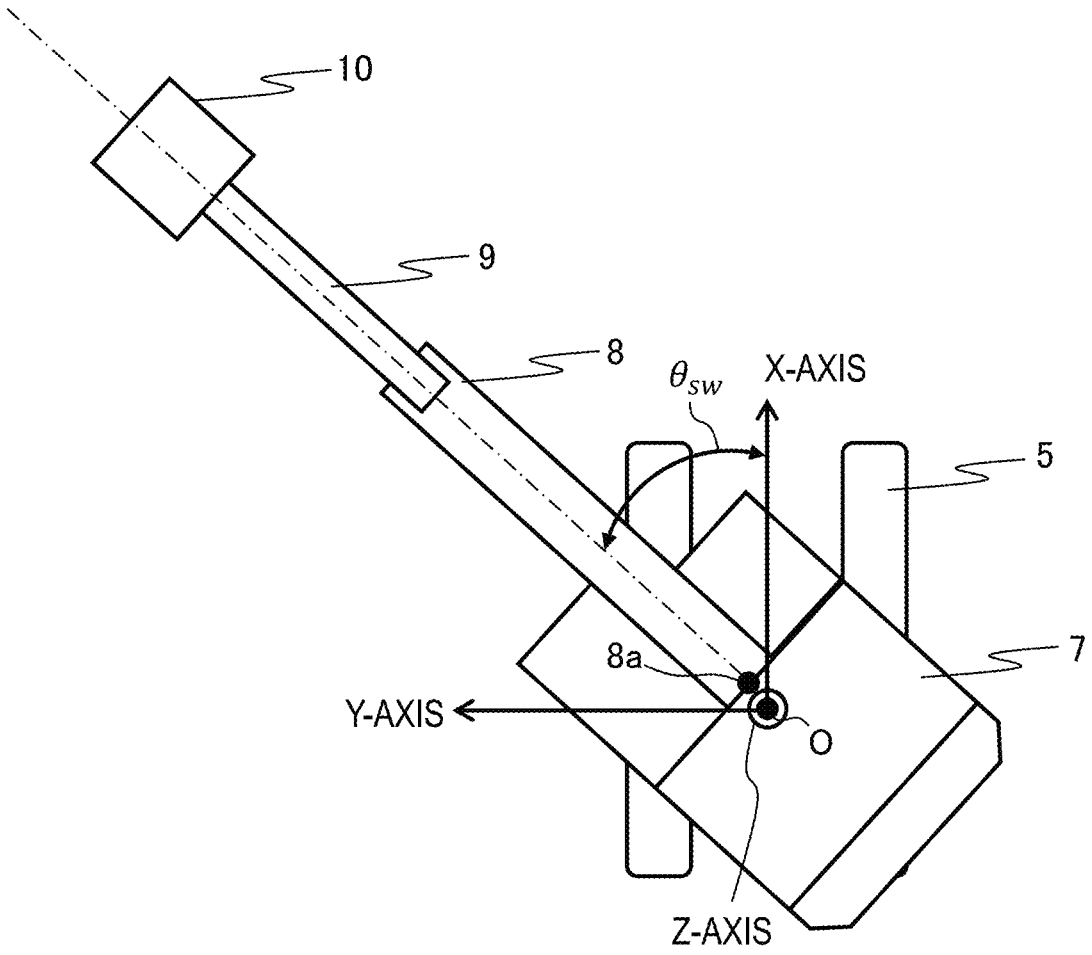
FIG. 5 is a diagram showing the excavator reference coordinate system viewed from the Z-axis direction.

The ROM of the controller 40 is pre-stored with a excavator reference coordinate system used for specifying the position and posture of the components of the hydraulic excavator 1. The excavator reference coordinate system of this embodiment is defined as a right-handed coordinate system with the origin O at the point where the swing center axis intersects with the ground G, as shown in FIGS. 4 and 5. The excavator reference coordinate system is defined with the forward direction of the lower track body 5 as the positive direction of the X-axis. The excavator reference coordinate system of this embodiment is defined with the direction extending upward parallel to the swing center axis from the origin O as the positive direction of the Z-axis. The excavator reference coordinate system of this embodiment is defined with the direction orthogonal to both the X-axis and Z-axis, and to the left of the lower track body 5 as the positive direction of the Y-axis. Thus, the excavator reference coordinate system of this embodiment is a coordinate system set based on the lower track body 5, with the XY plane fixed to the ground (travel surface) G that the lower track body 5 contacts.

In the excavator reference coordinate system of this embodiment, the swing angle θsw of the upper swing body 7 is 0 degrees when the hydraulic excavator 1 is in the reference posture, that is, when the work device 2 is parallel to the X-axis. In the state where the swing angle θsw of the upper swing body 7 is 0 degrees, the operating plane of the work device 2 is parallel to the XZ plane, the lifting direction of the boom 8 is in the positive direction of the Z-axis, and the dump direction of the arm 9 and the bucket 10 is in the positive direction of the X-axis.

The posture calculation section 41 calculates the posture of the components of the hydraulic excavator 1 in the excavator reference coordinate system from the detection signals of the posture detection device 53. Specifically, the posture calculation section 41 calculates the rotation angle of the boom 8 (hereinafter, also referred to as the boom angle) θbm relative to the X-axis from the detection signal of the rotation angle of the boom 8 outputted from the boom angle sensor 14. The posture calculation section 41 calculates the rotation angle of the arm 9 (hereinafter, also referred to as the arm angle) θam relative to the boom 8 from the detection signal of the rotation angle of the arm 9 outputted from the arm angle sensor 15. The posture calculation section 41 calculates the rotation angle of the bucket 10 (hereinafter, also referred to as the bucket angle) θbk relative to the arm 9 from the detection signal of the rotation angle of the bucket 10 outputted from the bucket angle sensor 17. The posture calculation section 41 calculates the swing angle θsw of the upper swing body 7 relative to the X-axis (lower track body 5) from the detection signal of the swing angle of the upper swing body 7 outputted from the swing angle sensor 19.

The posture calculation section 41 calculates the plane position specified by the X and Y coordinates, and the height from the ground G specified by the Z coordinate, of the boom 8, arm 9, and bucket 10 in the excavator reference coordinate system, based on the calculated rotation angles θbm, θam, θbk of the work device 2 and the swing angle θsw of the upper swing body 7, and the lengths of the boom Lbm, arm Lam, and bucket Lbk. The boom length Lbm is the length from the boom pin 8*a* to the arm pin 9*a*. The arm length Lam is the length from the arm pin 9*a* to the bucket pin 10*a*. The bucket length Lbk is the length from the bucket pin 10*a* to the tip (toe) of the bucket 10. The boom pin 8*a* is positioned offset by Lox in the X-axis direction from the swing center axis (Z-axis) when the swing angle is set to 0 degrees.

Although not shown, the posture calculation section 41 calculates the inclination angle (pitch angle and roll angle) of the machine body 3 (lower track body 5) relative to a reference plane, based on the detection signal of the inclination angle of the machine body 3 outputted from the inclination angle sensor 18. The reference plane is, for example, a horizontal plane orthogonal to the direction of gravity. The posture calculation section 41 calculates the ground angle γ of the bucket 10, which is the angle formed by the line passing through the tip of the bucket 10 and the bucket pin 10*a* with respect to the ground G, based on the respective rotation angles θbm, θam, θbk of the work device 2.

The to-be-loaded machine position calculation section 42 shown in FIG. 3 calculates the position of the to-be-loaded machine 200's bed 201 in the excavator reference coordinate system (the plane position specified by the X and Y coordinates, and the height from the ground G specified by the Z coordinate), based on the relative position information of the to-be-loaded machine 200's bed 201 detected by the object position detection device 54, the swing angle θsw of the upper swing body 7 calculated by the posture calculation section 41, and the mounting position of the object position detection device 54 in the excavator reference coordinate system. Thus, the controller 40 according to this embodiment acquires the relative position (X, Y, Z coordinates in the excavator reference coordinate system) of the bed 201 with respect to the hydraulic excavator 1 using the object position detection device 54. The position information of the bed 201 acquired by the controller 40 is, for example, the position coordinates of the four corners of the upper surface of the bed 201, namely, the position coordinates of the front and rear ends of the upper edge of the left side part 202*l* and the front and rear ends of the upper edge of the right side part 202*r*.

The speed calculation part 43 calculates the operation command speed of each hydraulic actuator 6, 11, 12, 13 based on the detection signal from the operation detection device 56. Specifically, the ROM of the controller 40 has a speed table stored in advance, which shows the relationship between the operation amount of the operation levers 22, 23 and the operation command speed of the hydraulic actuators 6, 11, 12, 13. The speed calculation section 43 calculates the operation command speed of each hydraulic actuator 6, 11, 12, 13 from the operation amount included in the operation information of the operation levers 22, 23 outputted from the operation detection device 56, by referring to this speed table.

The speed calculation section 43 converts the operation command speed of the swing hydraulic motor 6 into the swing speed ωsw of the upper swing body 7. The speed calculation section 43 converts the operation command speed of the boom cylinder 11 into the rotation speed of the boom 8. The speed calculation section 43 converts the operation command speed of the arm cylinder 12 into the rotation speed of the arm 9. The speed calculation section 43 converts the operation command speed of the bucket cylinder 13 into the rotation speed of the bucket 10.

The speed calculation section 43 calculates the actual rotation speed of the work device 2 from the time change of the rotation angles θbm, θam, θbk of the work device 2 calculated by the posture calculation section 41. The speed calculation section 43 calculates the actual swing speed ωswr of the upper swing body 7 from the time change of the swing angle θsw of the upper swing body 7 calculated by the posture calculation section 41.

The speed vector calculation section 44 calculates the speed vector generated in the work device 2 based on the calculation results of the posture calculation section 41 and the speed calculation section 43. Specifically, the speed vector calculation section 44 calculates the speed vector of the tip of the arm 9 based on the rotational angles θbm, θam, θbk of the work device 2 and the swing angle θsw of the upper swing body 7 calculated by posture calculation section 41, and the rotational speeds of the work device 2 and the swing speed of the upper swing body 7 calculated by the speed calculation section 43.

The condition determination section 45 determines whether the condition for executing the loading operation support control as interference prevention control, which is the condition for executing the loading operation support control (the first condition for executing interference prevention control), is satisfied. The condition for executing the loading operation support control includes the following Condition 1 and Condition 2. The condition for executing the loading operation support control is established when both Condition 1 and Condition 2 are satisfied, and is not established if either Condition 1 or Condition 2 is not satisfied.

[Condition 1] A swing operation in the direction from the outside of the bed 201 approaches the side part 202 of the bed 201 is performed in a plan view.

[Condition 2] The posture of the work device 2 is in a hauling posture.

When both Condition 1 and Condition 2 are satisfied, it can be determined that the operator has the intention to perform the hauling operation to transport the excavated material.

The condition determination section 45 determines, based on the relative position of the bed 201 to the hydraulic excavator 1 and the moving direction of the work device 2, whether a swing operation in the direction from the outside of the bed 201 approaches the side part 202 of the bed 201 has been performed by the operator in a plan view. For example, the condition determination section 45 determines, based on the position (plan position and height) of the bed 201 of the to-be-loaded machine 200 calculated by the to-be-loaded machine position calculation section 42 and the speed vector (parameter indicating the moving direction of the bucket 10) of the tip of the arm 9 calculated by the speed vector calculation section 44, whether a swing operation in the direction from the outside of the bed 201 approaches the side part of the bed 201 has been performed by the operator in a plan view.

The method for determining whether a swing operation in the direction from the outside of the bed 201 approaches the side part of the bed 201 has been performed in a plan view is not limited to this. For example, the condition determination section 45 may determine, based on the position of the bed 201 and the position of the tip of the arm 9 calculated by the posture calculation section 41, and the direction of the swing operation detected by the operation detection device 56 (left swing direction or right swing direction), whether a swing operation in the direction from the outside of the bed 201 approaches the side part 202 of the bed 201 has been performed in a plan view.

Furthermore, the condition determination section 45 may determine that Condition 1 is satisfied if the distance between the position of the bed 201 of the to-be-loaded machine 200 and the position of the hydraulic excavator 1 is less than a predetermined value and a swing operation has been performed. The condition determination section 45 may determine that Condition 1 is not satisfied if the distance between the position of the bed 201 of the to-be-loaded machine 200 and the position of the hydraulic excavator 1 is equal to or greater than a predetermined value, or if no swing operation has been performed.

The condition determination section 45 determines, based on the calculation result of the posture calculation section 41, whether the posture of the work device 2 is in a hauling posture or not. For example, the condition determination section 45 compares the absolute value of the ground angle γ of the bucket 10 calculated by the posture calculation section 41 with the ground angle threshold value γt. The ground angle threshold value γt is a threshold value for determining whether the posture of the work device 2 is in a hauling posture or not, and is stored in the ROM of the controller 40 in advance. The ground angle threshold γt, for example, adopts a value of approximately 10 degrees to 20 degrees.

The condition determination section 45 determines that the posture of the work device 2 is in a hauling posture when the absolute value of the ground angle γ of the bucket 10 calculated by the posture calculation section 41 is less than or equal to the ground angle threshold γt. The condition determination section 45 determines that the posture of the work device 2 is not in a hauling posture when the absolute value of the ground angle γ of the bucket 10 calculated by the posture calculation section 41 is greater than the ground angle threshold γt.

When the condition determination section 45 determines that the loading operation support control execution condition (the first interference prevention control execution condition) is satisfied, the loading operation support control, which is an interference prevention control during the loading operation, is executed. The interference prevention control is a control to prevent the bucket 10 from interfering with the bed 201. In this embodiment, the loading operation support control, which is an interference prevention control to prevent the bucket 10 from interfering with the bed 201 when the hydraulic excavator 1 performs a loading operation, is executed.

In the loading operation support control, the controller 40 generates and stores in a storage device a correlation map Ma (refer to FIG. 6) to assist the operator's operation so that the bucket 10 can move to the release position (discharge position) above the bed 201 without interfering with the bed 201 of the to-be-loaded machine 200 when a swing operation to move the bucket 10 to the release position above the bed 201 is performed by the operator.

Figure 6:
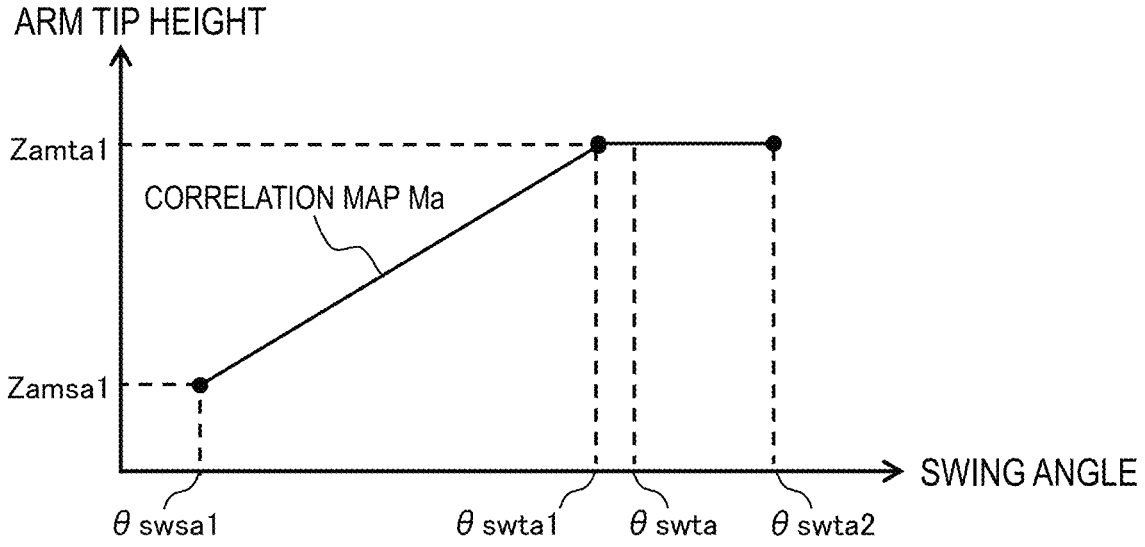
FIG. 6 is a diagram showing a correlation map Ma used by the controller according to the first embodiment during loading operations.
Figure 7:
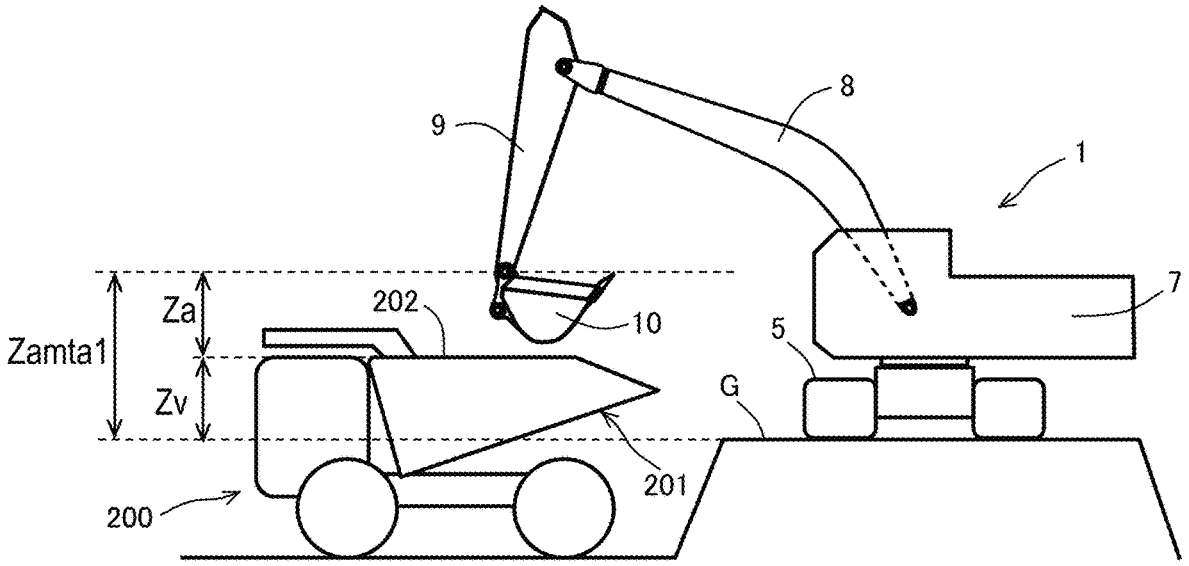
FIG. 7 is a side view of the hydraulic excavator and the machine to be loaded, showing the passage lower limit height Zamta1.

FIG. 6 is a diagram showing the correlation map Ma used by the controller 40 during the loading operation. As shown in FIG. 6, the correlation map Ma is a map that defines the minimum height of the arm tip according to the swing angle. The arm tip height refers to the height (distance in the Z-axis direction) from the ground G to the tip of the arm 9 (for example, the center of the bucket pin 10*a*). The vertical axis indicates the minimum value of the arm tip height. Zamta1 is the height of the tip of the arm 9 (interference prevention height) when the work device 2 is located above the side part 202 of the bed 201, as shown in FIG. 7, so that the side part 202 and the bucket 10 do not interfere, hereinafter also referred to as the passage minimum height. The passage minimum height Zamta1 is the height in the excavator reference coordinate system that the tip of the arm 9 should reach to pass over the side part 202 of the bed 201. Therefore, if the arm tip height is greater than the passage minimum height Zamta1, the bucket 10 can be moved from the outside to the inside of the bed 201 without interfering with the bed 201 by the swing action of the upper swing body 7.

Figure 8:
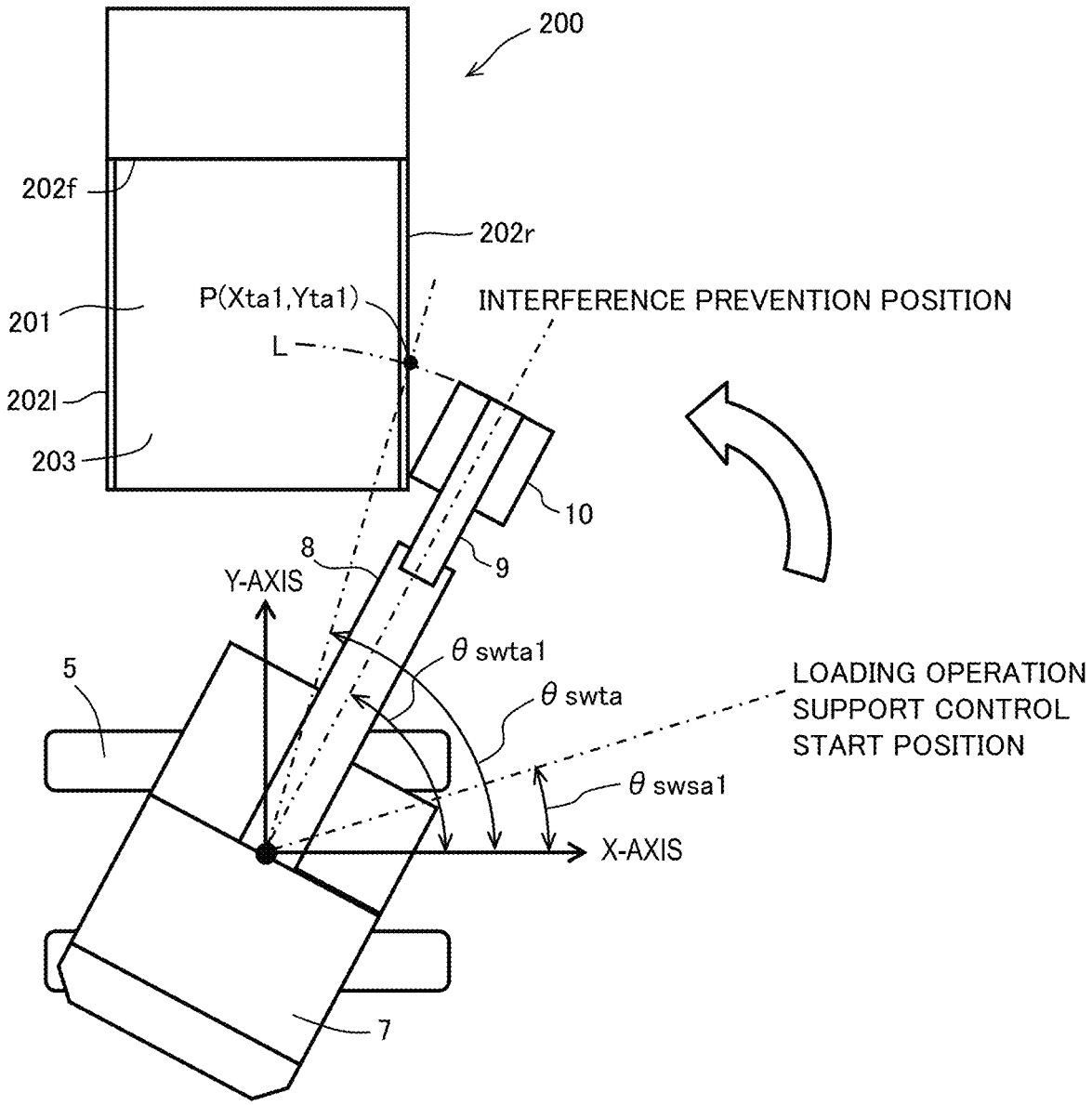
FIG. 8 is a plan view of the hydraulic excavator and the machine to be loaded, showing the control start swing angle θswsa1 and the interference prevention angle θswta1.
Figure 9:
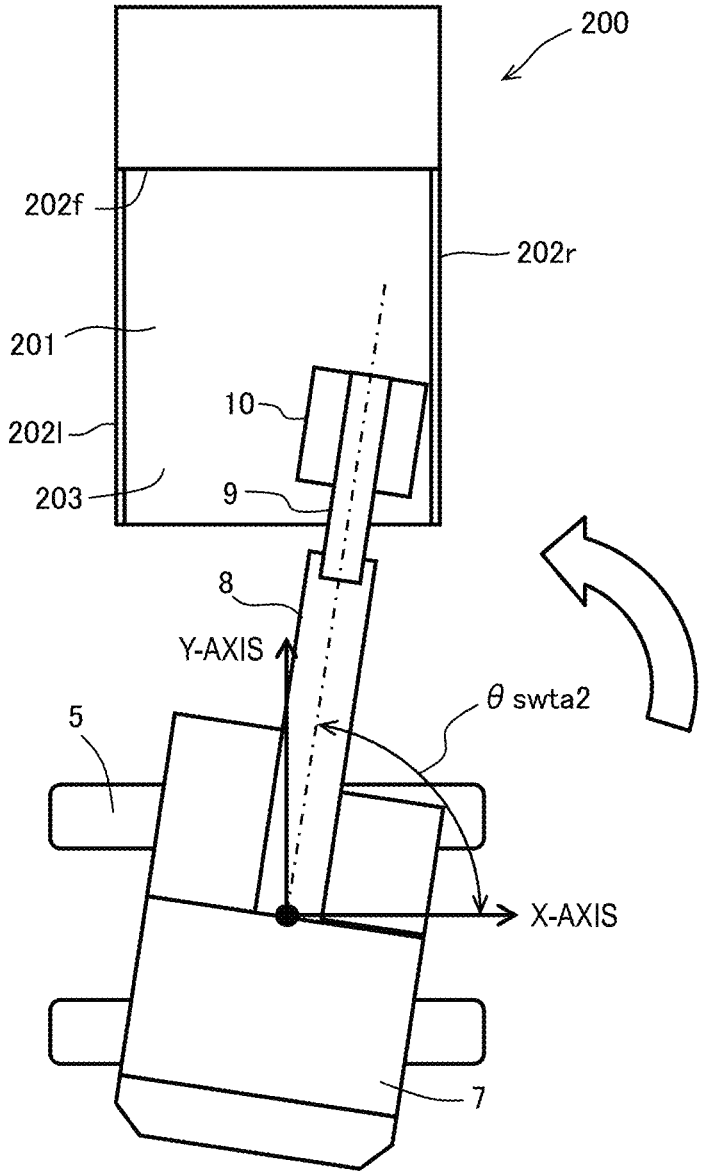
FIG. 9 is a plan view of the hydraulic excavator and the machine to be loaded, showing the inner-bed reach angle θswta2.

As shown in FIG. 6, the horizontal axis of the correlation map Ma indicates the swing angle, with the swing angle at the standard posture of the hydraulic excavator 1 being 0 degrees, and increasing as it swings to the left. θswsa1 is the swing angle at the position (operation start position), that is, the position where the loading operation support control starts (control start position) in the loading operation, as shown in FIG. 8, hereinafter also referred to as the control start swing angle. θswta is the swing angle at the position where the predicted movement trajectory L of the tip of the arm 9 and the outer surface of the side part 202*r* of the bed 201 of the to-be-loaded machine 200 intersect in plan view, that is, the position where the bucket 10 overlaps with the side part 202*r* of the bed 201 in plan view, hereinafter also referred to as the lap swing angle. The predicted movement trajectory L is the movement trajectory of the tip of the arm 9 when the arm tip height is the passage minimum height Zamta1.

θswta1 is the swing angle when the work device 2 is positioned at the interference prevention position, hereinafter also referred to as the interference prevention angle. The interference prevention position is a position near the bed 201 where, even if the height of the arm tip is lower than the interference prevention height, the bucket 10 does not interfere with the bed 201. The interference prevention angle θswta1 can also be said to be the swing angle for specifying the interference prevention position. θswta2, as shown in FIG. 9, is the swing angle when the entire bucket 10 crosses over the side part 202*r* from outside the bed 201 and is positioned inside the bed 201, hereinafter also referred to as the inner-bed reach angle.

The controller 40, referring to the correlation map Ma shown in FIG. 6, controls the operation of the work device 2 and the upper swing body 7 so that the height of the arm tip does not fall below the lower limit defined in the correlation map Ma. The method for generating the correlation map Ma and the detailed control method for the work device 2 will be described below.

When the loading operation support control execution condition is met, the posture calculation section 41, as shown in FIG. 3, specifies the operation start position, which is the circumferential position of the arm 9 tip before the swing operation, based on the posture of the work device 2 detected by the posture detection device 53 at the time the condition is met. Specifically, the posture calculation section 41 calculates the swing angle θsw of the upper swing body 7 at the start of the loading operation support control (when the loading operation support control execution condition is met) as the control start swing angle θswsa1. The posture calculation section 41 also calculates the height of the arm 9 tip at the start of the loading operation support control as the control start height Zamsa1.

Furthermore, the target angle calculation section 46, as shown in FIG. 7, calculates the passage minimum height Zamta1 by adding the height Zv of the bed 201 in the excavator reference coordinate system, which is calculated by the to-be-loaded machine position calculation section 42, and a predetermined setting value Za. The height Zv of the bed 201 is specifically the height from the ground G to the upper edge of the side part 202 of the bed 201 in the excavator reference coordinate system. The setting value Za is set by adding the bucket length Lbk and a margin.

Moreover, the posture calculation section 41 calculates the arm angle θam at the start of the loading operation support control as the control start arm angle θamsa1. When the loading operation support control execution condition is met, the target angle calculation section 46 calculates the passage minimum boom angle θbmta1, which is the boom angle at which the arm tip height becomes the passage minimum height Zamta1, based on the control start arm angle θamsa1 and the passage minimum height Zamta1.

Additionally, as shown in FIG. 8, when the loading operation support control execution condition is met, the target angle calculation section 46 calculates the interference prevention angle θswta1 based on the passage minimum boom angle θbmta1. This angle is the circumferential angle position of the arm 9 tip in the swing direction, which is determined to be free of interference between the bed 201 and the work device 2, between the operation start position identified outside the bed 201 and the first side part 202 (in the example shown in FIG. 8, the right side part 202*r*) of the multiple side parts 202 of the bed 201 that the work device 2 can first reach after the operation of the upper swing body 7.

The specific calculation methods for the passage minimum boom angle θbmta1 and the interference prevention angle θswta1 will be explained. In the following equations (1) to (4), it is assumed that the width dimension of the work device 2 can be ignored. In the excavator reference coordinate system the height of the tip of the arm 9 from the ground G, which is the arm tip height Zam, is determined by the following equation (1).

[Math. 1]

$$Z_{am} = L_{oz} - L_{bm}\sin\theta_{bm} - L_{am}\sin(\theta_{bm} + \theta_{am}) \quad (1)$$

Loz is the height of the boom pin 8*a* from the ground G in the excavator reference coordinate system. Lbm is the boom length, Lam is the arm length, θbm is the boom angle, and θam is the arm angle. As described later, the arm angle θam is maintained at the control start arm angle θamsa1 from the start of the loading operation support control until the conditions for enabling the operation of the arm 9 are met.

The passage lower limit boom angle θbmta1, which is the boom angle when the tip of the arm 9 is at the passage lower limit height Zamta1, is determined by the following equation (2).

[Math. 2]

$$\theta_{bmta1} = \sin^{-1}\left(\frac{-Z_{amta1}}{\sqrt{a_{ta1}^2 + b_{ta1}^2}}\right) - \alpha_{ta1} \quad (2)$$

In equation (2), ata1, bta1, and cta1 are coefficients related to the synthesis of trigonometric functions.

Once the passage lower limit boom angle θbmta1 is determined, the distance from the center of swing axis (Z-axis) to the tip of the arm 9 (hereinafter also referred to as the arm tip distance) Rta1 is determined by the following equation (3).

[Math. 3]

$$R_{ta1} = L_{ox} + L_{bm}\cos\theta_{bmta1} + L_{am}\cos(\theta_{bmta1} + \theta_{am}) \quad (3)$$

Lox is the distance (offset) from the swing center axis (Z-axis) to the boom pin 8*a*.

When the arm tip distance Rta1 is used for the swing operation, the position of the intersection point P between the predicted movement trajectory L of the tip of the arm 9 and the outer surface of the side part 202 of the bed 201 of the to-be-loaded machine 200 in the excavator reference coordinate system is Xta1, Yta1 (see FIG. 8), and the lap swing angle θswta is determined by the following equation (4).

[Math. 4]

$$\theta_{swta} = \tan^{-1}\left(\frac{Y_{ta1}}{X_{ta1}}\right) \quad (4)$$

The lap swing angle θswta is the swing angle when the bucket 10 is positioned directly above the side part 202 and, in a plan view, the side part 202 and the bucket 10 overlap.

The target angle calculation section 46 calculates the interference prevention angle θswta1 by adding a predetermined margin θswtam to the lap swing angle θswta (θswta1=θswta+θswtam). The predetermined margin θswtam is added so that the work device 2 is positioned away from the side part 202 towards the outside of the bed 201. For example, if the lap swing angle θswta in the left swing direction from the standard posture is represented by a positive value, the margin θswtam becomes a negative value. The absolute value of the margin is greater than at least half the width of the bucket 10.

The target angle calculation section 46 calculates the inner-bed reach angle θswta2 by adding a predetermined margin θswtam2 to the lap swing angle θswta (θswta2=θswta+θswtam2). The predetermined margin θswtam2 is added so that the work device 2 is positioned away from the side part 202 towards the inside of the bed 201. For example, if the lap swing angle θswta in the left swing direction from the standard posture is represented by a positive value, the margin θswtam2 becomes a positive value. The absolute value of the margin is greater than at least half the width of the bucket 10.

The correlation map generation section 49 shown in FIG. 3 generates a correlation map Ma for use during loading operation support, as shown in FIG. 6, based on the calculation results of the target angle calculation section 46. The correlation map Ma is from the control start swing angle θswsa1 to the interference prevention angle θswt up to al, as the swing angle increases, the minimum height of the arm tip monotonically increases from the control start height Zamsa1, and is generated such that the minimum height of the arm tip reaches the passage minimum height Zamta1 by the interference prevention angle θswta1. Furthermore, the correlation map Ma is generated such that the minimum height of the arm tip remains at the passage minimum height Zamta1 from the interference prevention angle θswta1 to the inner-bed reach angle θswta2.

Thus, the controller 40 calculates the minimum height value in the height direction of the work device 2 according to the angular position in the swing direction of the tip of the arm 9, in the operating range of the upper swing body 7 from the operation start position identified by the control start swing angle θswsa1 to the interference prevention position identified by the interference prevention angle θswta1, such that the closer to the interference prevention position, the greater and at the interference prevention position, the passage minimum height (interference prevention height) Zamta1 is reached.

As described later, when the swing angle exceeds the interference prevention angle θswta1, the operation of the arm 9 becomes effective. Therefore, when the swing angle is above the interference prevention angle θswta1, the arm angle θam may change due to the operator's operation. When the arm angle θam changes, the reach (arm tip distance) of the work device 2 when viewed in plan changes. Hence the inner-bed reach angle θswta2, which is the swing angle at which the entire bucket fits within the bed 201, dynamically changes. That is, the target angle calculation section 46 recalculates the inner-bed reach angle θswta2 when the arm angle θam changes. The correlation map generation section 49 updates the correlation map Ma based on the recalculated inner-bed reach angle θswta2.

The posture comparison section 47 shown in FIG. 3 compares the swing angle θsw calculated by the posture calculation section 41 and the interference prevention angle θswta1 calculated by the target angle calculation section 46. The posture comparison section 47, based on the comparison result, determines whether the condition for enabling the operation of the arm 9 has been met. The condition for enabling the operation of the arm 9 includes the tip of the arm 9 reaching an angular position in the swing direction beyond the interference prevention position while exceeding the interference prevention height. The posture comparison section 47 determines that the tip of the arm 9 has not exceeded the interference prevention position when the swing angle θsw is less than the interference prevention angle θswta1. In other words, the posture comparison section 47 determines that the enabling condition has not been met. The posture comparison section 47 determines that the tip of the arm 9 has exceeded the interference prevention position when the swing angle θsw is equal to or greater than the interference prevention angle θswta1. The minimum height value in the height direction of the work device 2 at the interference prevention position is the passage minimum height (interference prevention height) Zamta1. Therefore, the posture comparison section 47 determines that the enabling condition has been met when the swing angle θsw is equal to or greater than the interference prevention angle θswta1.

Furthermore, the posture comparison section 47 compares the arm tip height Zam calculated by the posture calculation section 41 and the passage minimum height Zamta1 calculated by the target angle calculation section 46.

The posture comparison section 47 determines whether the conditions for automatically executing the boom raising operation (hereinafter, also referred to as automatic boom raising control execution conditions) are met based on the comparison result between the arm tip height Zam and the passage lower limit height Zamta1.

The automatic boom raising control execution conditions include at least the following Condition 3. The automatic boom raising control execution conditions is met when the interference prevention control is being executed, and Condition 3 is satisfied. The automatic boom raising control execution conditions is not met if Condition 3 is not satisfied.

[Condition 3] The arm tip height Zam is equal to or less than the passage lower limit height Zamta1.

Furthermore, the posture comparison section 47 compares the swing angle θsw calculated by the posture calculation section 41 with the inner-bed reach angle θswta2 calculated by the target angle calculation section 46. The posture comparison section 47 determines whether the bucket 10 has passed the side part 202 (only the first reachable side part 202*r* among side parts 202*r* and 202*l*) of the bed 201 in plan view after swinging beyond the interference prevention position, that is, whether the entire bucket 10 has reached inside the bed 201 at a position in the swing direction that is beyond side part 202*r* and in front of side part 202*l*. The posture comparison section 47 determines that the entire bucket 10 has not reached inside the bed 201 when the swing angle θsw is less than the inner-bed reach angle θswta2. The posture comparison section 47 determines that the entire bucket 10 has reached inside the bed 201 when the swing angle θsw is equal to or greater than the inner-bed reach angle θswta2.

The target speed calculation section 48 calculates the target speed for the hydraulic actuators driving the boom 8, arm 9, bucket 10, and upper swing body 7, etc., based on the operation command speed calculated by the speed calculation section 43. The actuator control section 39 outputs control signals to the electromagnetic proportional valve 51 so that each hydraulic actuator (boom cylinder 11, arm cylinder 12, bucket cylinder 13, and swing hydraulic motor 6, etc.) operates at the target speed calculated by the target speed calculation section 48.

Additionally, when the loading operation support control execution conditions are met, the target speed calculation section 48 calculates the target speed for each hydraulic actuator based on the posture of the hydraulic excavator 1 calculated by the posture calculation section 41 and the correlation map Ma.

The detailed method for calculating the target speed for each hydraulic actuator by the target speed calculation section 48 in the loading operation support control is as follows.

When the loading operation support control execution conditions are met, the target speed calculation section 48 executes a disabling process that invalidates the arm operation by the operator while the swing angle θsw calculated by the posture calculation section 41 has not reached the interference prevention angle θswta1, that is, while the activation conditions for operating arm 9 determined by the posture comparison section 47 are not met. In the disabling process, even if the operation command speed for the arm cylinder 12 calculated by the speed calculation section 43 is not zero, the target speed calculation section 48 sets the target speed for the arm cylinder 12 to zero. Thus, in this embodiment, the controller 40 invalidates the operation of arm 9 by the operation device 20 during the operation of the upper swing body 7 until the activation conditions are met in the loading operation support control. In other words, the controller 40 disables the operation of the arm 9 by the arm operating device (operating device 20) while the upper swing body 7 is moving from the start position of operation to the interference prevention position.

The target speed calculation section 48 does not execute the invalidation process when the posture comparison section 47 determines that the conditions for enabling the operation of arm 9 are met. That is, the target speed calculation section 48 sets the target speed of the arm cylinder 12 as the operation command speed of the arm cylinder 12 calculated by the speed calculation section 43. Thus, the controller 40 according to this embodiment enables the operation of the arm 9 by the operating device 20 when the enabling conditions are met in the loading operation support control.

The target speed calculation section 48 sets a predetermined automatic boom raising speed as the target speed of the boom cylinder 11, regardless of the operator's boom operation, when the posture comparison section 47 determines that the conditions for executing automatic boom raising control are met. The automatic boom raising speed is stored in the ROM of the controller 40 beforehand. Moreover, the target speed calculation section 48 does not perform the process of setting the automatic boom raising speed as the target speed of the boom cylinder 11 when the posture comparison section 47 determines that the conditions for executing automatic boom raising control are not met.

The target speed calculation section 48 compares the arm tip height Zam calculated by the posture calculation section 41 with the correlation map Ma generated by the correlation map generation section 49, and sets the target swing speed so that the arm tip height Zam does not fall below the lower limit defined by the correlation map Ma due to the swing operation.

Specifically, the target speed calculation section 48 calculates the limited swing speed ωswt that satisfies the slope a of the correlation map Ma from the rotational speed (angular velocity) ωbm of the boom 8 calculated by the speed calculation section 43.

The target speed calculation section 48 compares the swing speed ωsw calculated by the speed calculation section 43 in response to the operator's swing operation with the limited swing speed ωswt. The target speed calculation section 48, based on the comparison result, determines whether the arm tip height Zam falls below the lower limit defined by the correlation map Ma due to the operator's swing operation.

The target speed calculation section 48 determines that the arm tip height Zam does not fall below the lower limit defined by the correlation map Ma if the swing speed ωsw is less than or equal to the limited swing speed ωswt. If the swing speed ωsw is greater than the limited swing speed ωswt, the target speed calculation section 48 determines that the arm tip height Zam falls below the lower limit defined by the correlation map Ma due to the operator's swing operation.

If it is determined that the arm tip height Zam does not fall below the lower limit defined by the correlation map Ma due to the operator's swing operation, the target speed calculation section 48 sets the operation command speed of the swing hydraulic motor 6, calculated by the speed calculation section 43, as the target speed of the swing hydraulic motor 6. Consequently, the upper swing body 7 operates at the swing speed ωsw in accordance with the operator's swing operation. If it is determined that the arm tip height Zam falls below the lower limit defined by the correlation map Ma due to the operator's swing operation, the target speed calculation section 48 sets the target speed of the swing hydraulic motor 6 to a speed corresponding to the limited swing speed ωswt. Accordingly, the upper swing body 7 operates at a limited swing speed ωswt, which is lower than the swing speed corresponding to the operator's swing operation. That is, the swing motion of the upper swing body 7 is decelerated.

As such, the controller 40 according to the present embodiment controls the automatic raising operation of the boom 8 and the operation restriction of the upper swing body 7 so that the arm tip height Zam does not fall below the lower limit defined by the correlation map Ma.

Furthermore, the target speed calculation section 48 determines whether the arm tip height Zam falls below the lower limit (passage lower limit height Zamta1) defined by the correlation map Ma, based on the arm operation by the operator, when the swing angle θsw is equal to or greater than the interference prevention angle θswta1 and less than the cargo bed reach angle θswta2. The target speed calculation section 48 determines that the arm tip height Zam does not fall below the lower limit (passage lower limit height Zamta1) defined by the correlation map Ma if the speed vector of the arm tip calculated by the speed vector calculation section 44 does not include a downward component. The target speed calculation section 48 determines that the arm tip height Zam falls below the lower limit (passage lower limit height Zamta1) defined by the correlation map Ma if the speed vector of the arm tip calculated by the speed vector calculation section 44 includes a downward component.

If the target speed calculation section 48 determines that the arm tip height Zam does not fall below the lower limit (passage lower limit height Zamta1) defined by the correlation map Ma based on the operator's arm operation, it sets the target speed of the boom cylinder 11 to 0 (zero). The target speed calculation section 48 also sets the operation command speed of the arm cylinder 12 calculated by the speed calculation section 43 as the target speed of the arm cylinder 12.

If the target speed calculation section 48 determines that the arm tip height Zam falls below the lower limit (passage lower limit height Zamta1) defined by the correlation map Ma based on the operator's arm operation, it calculates the target speed in the extension direction (raising direction of boom 8) of the boom cylinder 11 so that the arm tip height Zam does not fall below the lower limit defined by the correlation map Ma. The target speed calculation section 48 may, instead of or in addition to calculating the target speed in the extension direction of the boom cylinder 11, set the target speed of the arm cylinder 12 to 0 (zero).

Thus, the controller 40 according to the present embodiment controls the operation of at least one of the boom 8 and the arm 9 so that the height of the tip of the arm 9, which operates in response to the operation of the operating device 20, does not fall below the passage lower limit height (interference prevention height) Zamta1, unless it is determined that the bucket 10 has passed the side part 202 of the cargo bed 201 in plan view.

The controller 40 according to the this embodiment terminates the loading operation support control when the swing angle θsw reaches or exceeds the inner-bed reach angle θswta2. That is, the target speed calculation section 48 sets the operation command speed of the arm cylinder 12 calculated by the speed calculation section 43 as the target speed of the arm cylinder 12 when the swing angle θsw reaches or exceeds the inner-bed reach angle θswta2.

Accordingly, the controller 40 according to the this embodiment, when it is determined that the bucket 10 has passed through the side part 202 of the bed 201 in a plan view, permits the operation of the tip of the arm 9 to a position lower than the passage lower limit height (interference prevention height) Zamta1.

Figure 10:
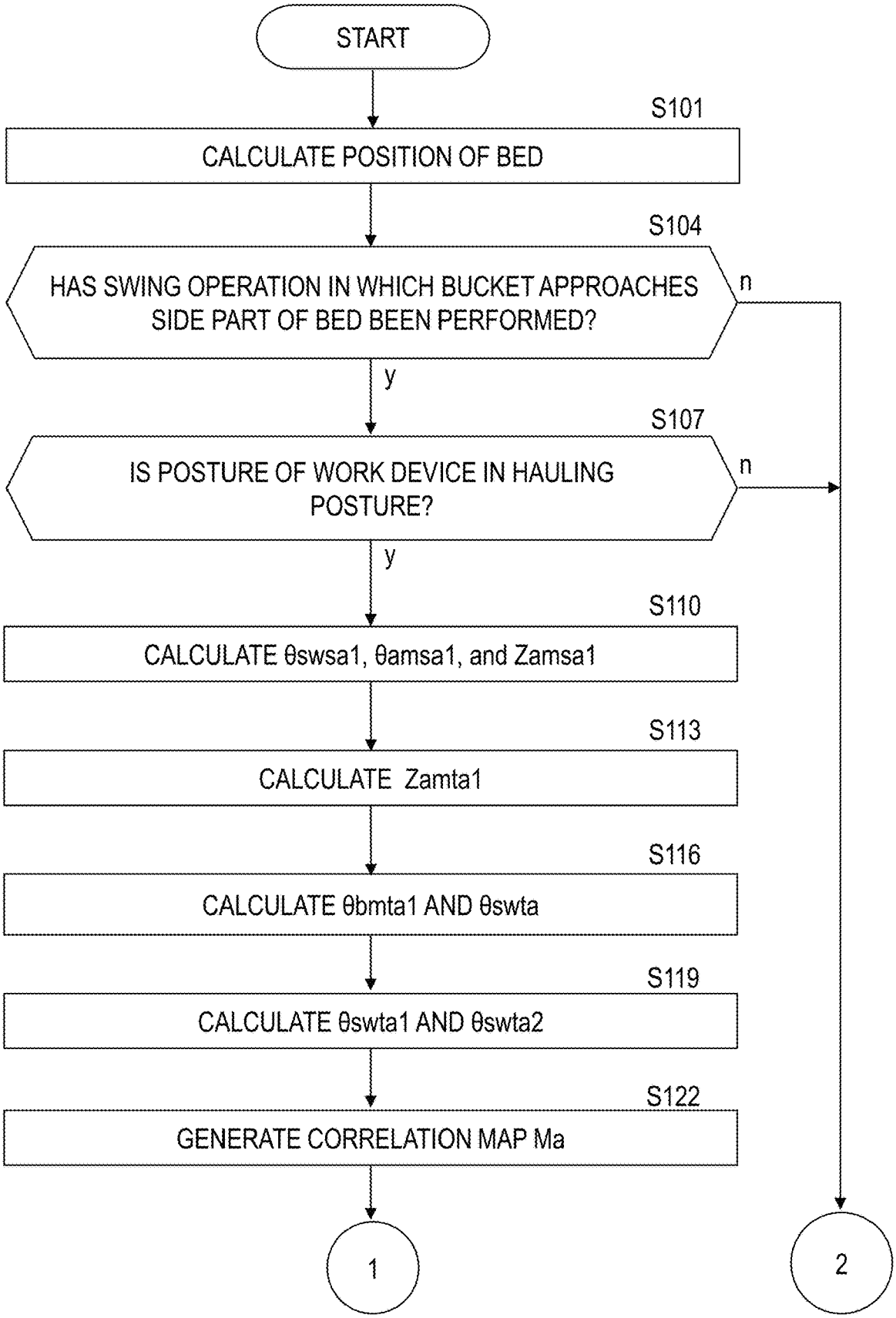
FIG. 10 is a flowchart showing an example of the process flow of loading operation support control executed by the controller according to the first embodiment, showing the processes from step S101 to S122.
Figure 11:
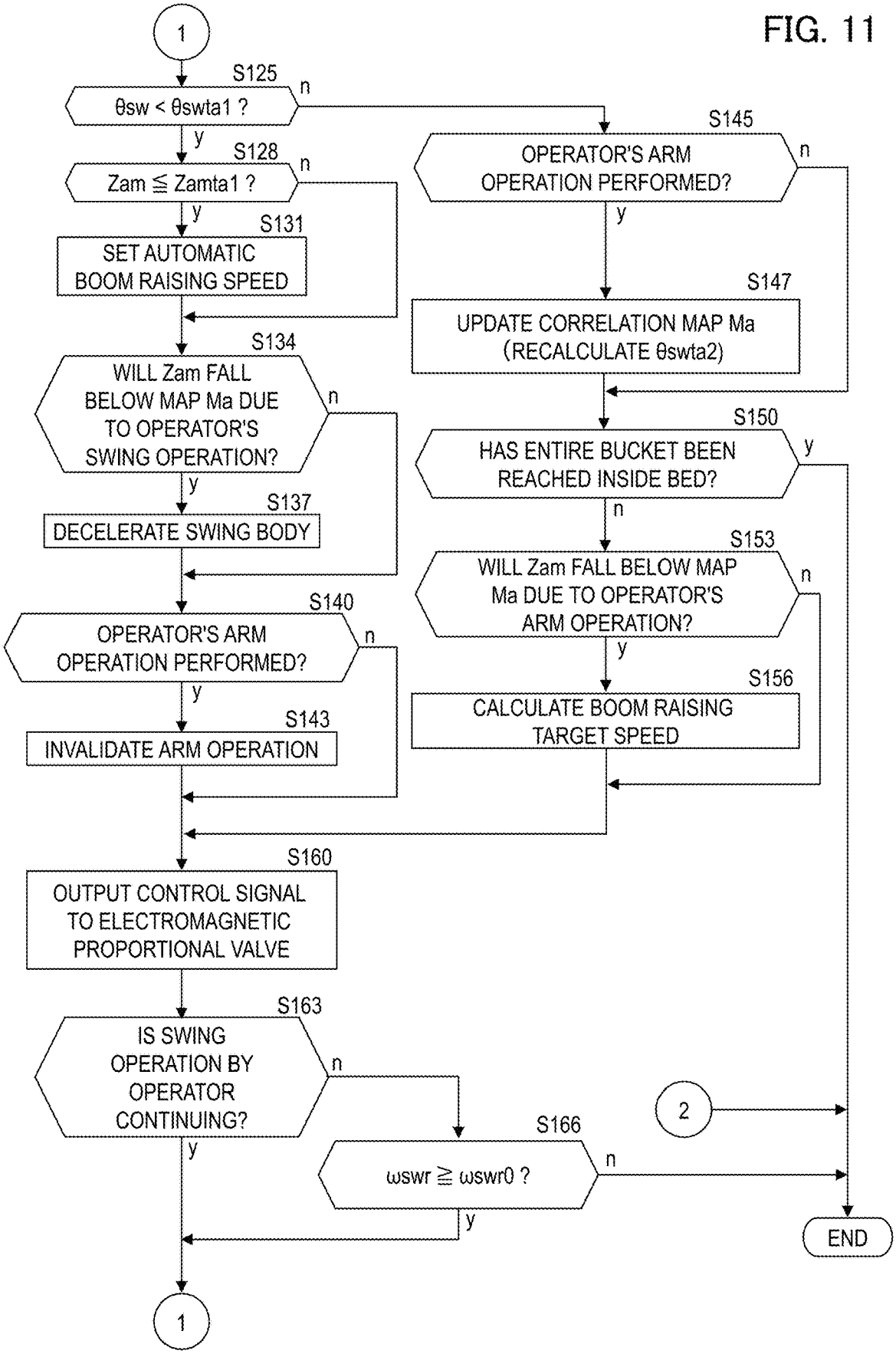
FIG. 11 is a flowchart showing an example of the process flow of loading operation support control executed by the controller according to the first embodiment, showing the processes from step S125 to S166.

Referring to FIGS. 10 and 11, an example of the flow of the loading operation support control process executed by the controller 40 will be described. The process shown in the flowcharts of FIGS. 10 and 11 starts when the ignition switch (not shown) is turned on and is repeatedly executed at a predetermined control cycle.

As shown in FIG. 10, at step S101, the to-be-loaded machine position calculation section 42 calculates the relative position of the bed 201 of the to-be-loaded machine 200 to the hydraulic excavator 1 based on the detection results of the object position detection device 54.

At the next step S104, the condition determination section 45 determines, based on the position of the loading platform 201 calculated in step S101 and the speed vector of the tip of the arm calculated by the speed vector calculation section 44, whether the operator has performed a swing operation in which the bucket 10 approaches the side part 202 of the bed 201 from outside in a plan view.

At step S104, if it is determined that the operator has performed a swing operation in which the bucket 10 approaches the side part 202 of the bed 201 from outside in a plan view, the process proceeds to step S107. If it is determined at step S104 that the operator has not performed such a swing operation, the process shown in the flowcharts of FIGS. 10 and 11 ends.

At step S107, the condition determination section 45 determines, based on the ground angle γ of the bucket 10 calculated by the posture calculation section 41, whether the posture of the work device 2 is in a hauling posture. If it is determined at step S107 that the posture of the work device 2 is in a hauling posture, the process proceeds to step S110. If it is determined at step S107 that the posture of the work device 2 is not in a hauling posture, the process shown in the flowcharts of FIGS. 10 and 11 ends.

If affirmative determinations are made in each of the determination processes at steps S104 and S107, the conditions for initiating the loading operation support control are met, and the loading operation support control begins. In the loading operation support control, first, at step S110, the posture calculation section 41 calculates the control start swing angle θswsa1, the control start arm angle θamsa1, and the control start height Zamsa1.

At the next step S113, the target angle calculation section 46 calculates the passage lower limit height Zamta1. At the next step S116, the target angle calculation unit 46 calculates the passage lower limit boom angle θbmta1 and the lap swing angle θswta. At the next step S119, the target angle calculation section 46 calculates the interference prevention angle θswta1 and the inner-bed reach angle θswta2.

At the next step S122, the correlation map generation section 49 generates a correlation map Ma (refer to FIG. 6) based on the calculation results at steps S110, S113, S119.

In the next step S125, the posture comparison section 47 determines whether the current swing angle θsw calculated by the posture calculation unit 41 is less than the interference prevention angle θswta1 calculated in step S119. If it is determined in step S125 that the current swing angle θsw is less than the interference prevention angle θswta1, the process proceeds to step S128. If it is determined in step S125 that the current swing angle θsw is equal to or greater than the interference prevention angle θswta1, the condition for enabling the operation of arm 9 is met, and the process proceeds to step S145.

In step S128, the posture comparison section 47 determines whether the current arm tip height Zam calculated by the posture calculation section 41 is equal to or less than the passage minimum height Zamta1 calculated in step S113. If it is determined in step S128 that the current arm tip height Zam is equal to or less than the passage minimum height Zamta1, the process proceeds to step S131. If it is determined in step S128 that the current arm tip height Zam is greater than the passage minimum height Zamta1, the process proceeds to step S134.

If a positive determination is made in the determination process of step S128, the condition for executing automatic boom raising control is met. Accordingly, in step S131, the target speed calculation section 48 sets the target speed of the boom cylinder 11 to a predetermined automatic boom raising speed. Once the process in step S131 is completed, the process proceeds to step S134.

In step S134, the target speed calculation section 48 determines, based on the swing speed ωsw corresponding to the operator's swing operation and the limited swing speed ωswt, whether the arm tip height Zam will fall below the minimum value defined by the correlation map Ma due to the operator's swing operation. If it is determined in step S134 that the arm tip height Zam will fall below the minimum value defined by the correlation map Ma due to the operator's swing operation, the process proceeds to step S137. If it is determined in step S134 that the arm tip height Zam will not fall below the minimum value defined by the correlation map Ma due to the operator's swing operation, the process proceeds to step S140.

In step S137, the target speed calculation section 48 sets the target speed of the swing hydraulic motor 6 to a speed corresponding to the limited swing speed ωswt. The processes in steps S131 and S137 ensure that the swing operation and the boom raising operation are combined so that the arm tip height does not fall below the minimum value defined by the correlation map Ma. Although not shown, if a negative determination is made in step S134, the operation command speed corresponding to the operator's swing operation amount is set as the target speed of the swing hydraulic motor 6. Once the process in step S137 is completed, the process proceeds to step S140.

In step S140, the target speed calculation section 48 determines whether there is an arm operation by the operator based on the operation command speed of the arm cylinder 12 calculated by the speed calculation section 43. The target speed calculation section 48 determines that there is arm operation by the operator if the command speed of the arm cylinder 12 is not 0 (zero), and determines that there is no arm operation by the operator if the command speed of the arm cylinder 12 is 0 (zero). If it is determined that there is arm operation by the operator at step S140, the process proceeds to step S143. If it is determined that there is no arm operation by the operator at step S140, the process proceeds to step S160.

At step S143, the target speed calculation section 48 sets the target arm speed to 0 (zero). Thus, the process at step S143 can be said to be a disabling process to invalidate the arm operation by the operator. Once the process at step S143 is completed, the process proceeds to step S160.

At step S145, the target angle calculation section 46 performs the same process as at step S140. If it is determined that there is arm operation by the operator at step S145, the process proceeds to step S147. If it is determined that there is no arm operation by the operator at step S145, the process proceeds to step S150.

At step S147, the target angle calculation section 46 recalculates the inner-bed reach angle θswta2, and the correlation map generation section 49 updates the correlation map Ma. Once the process at step S147 is completed, the process proceeds to step S150.

At step S150, the posture comparison section 47 determines whether the entire bucket 10 has reached inside the bed 201 in a plan view, based on the current swing angle θsw calculated by the posture calculation section 41 and the inner-bed reach angle θswta2. If it is determined at step S150 that the entire bucket 10 has not reached inside the bed 201 in a plan view, the process proceeds to step S153. If it is determined at step S150 that the entire bucket 10 has reached inside the bed 201 in a plan view, the process shown in the flowcharts of FIGS. 10 and 11 is completed.

At step S153, the target speed calculation section 48 determines whether the arm tip height Zam falls below the lower limit (passage lower limit height Zamta1) defined by the correlation map Ma based on the speed vector of the arm tip calculated by the speed vector calculation section 44 due to the operator's arm operation. If it is determined at step S153 that the arm tip height Zam falls below the lower limit defined by the correlation map Ma due to the operator's arm operation, the process proceeds to step S156. If it is determined at step S153 that the arm tip height Zam does not fall below the lower limit defined by the correlation map Ma due to the operator's arm operation, the process proceeds to step S160.

At step S156, the target speed calculation section 48 calculates the target speed of the boom cylinder 11 for raising the boom so that the arm tip height Zam does not fall below the lower limit defined by the correlation map Ma. Thus, the arm operation and the boom raising operation are combined so that the arm tip height does not fall below the passage lower limit height Zamta1. Once the process at step S156 is completed, the process proceeds to step S160.

In step S160, the actuator control section 39 outputs a control signal to the electromagnetic proportional valve 51 according to the target speed calculated by the target speed calculation section 48. In the following step S163, the condition determination section 45 determines whether the swing operation by the operator is continuing or not, based on the calculation result of the speed vector calculation section 44 or the speed calculation section 43.

For example, if the speed vector of the tip of the arm 9 calculated by the speed vector calculation section 44 includes a component in the swing direction, the condition determination section 45 determines that the swing operation by the operator is continuing. If the speed vector of the tip of the arm 9 does not include a component in the swing direction, the condition determination section 45 determines that the swing operation by the operator is not continuing.

The condition determination section 45 may determine that the swing operation by the operator is continuing if the command speed of the swing hydraulic motor 6 calculated by the speed calculation section 43 is not zero. The condition determination section 45 may determine that the seivel operation by the operator is not continuing if the command speed of the swing hydraulic motor 6 calculated by the speed calculation section 43 is zero.

If it is determined in step S163 that the swing operation by the operator is continuing, the process returns to step S125. If it is determined in step S163 that the swing operation by the operator is not continuing, the process proceeds to step S166.

In step S166, the condition determination section 45 determines whether the actual swing speed ωswr calculated by the speed calculation section 43 is equal to or greater than the speed threshold ωswr0. The process of step S166 corresponds to determining whether the upper swing body 7 is operating due to inertia. If it is determined in step S166 that the actual swing speed ωswr is equal to or greater than the speed threshold ωswr0, the process returns to step S125. If it is determined in step S166 that the actual swing speed ωswr is less than the speed threshold ωswr0, the process shown in the flowcharts of FIGS. 10 and 11 is completed.

Figure 12:
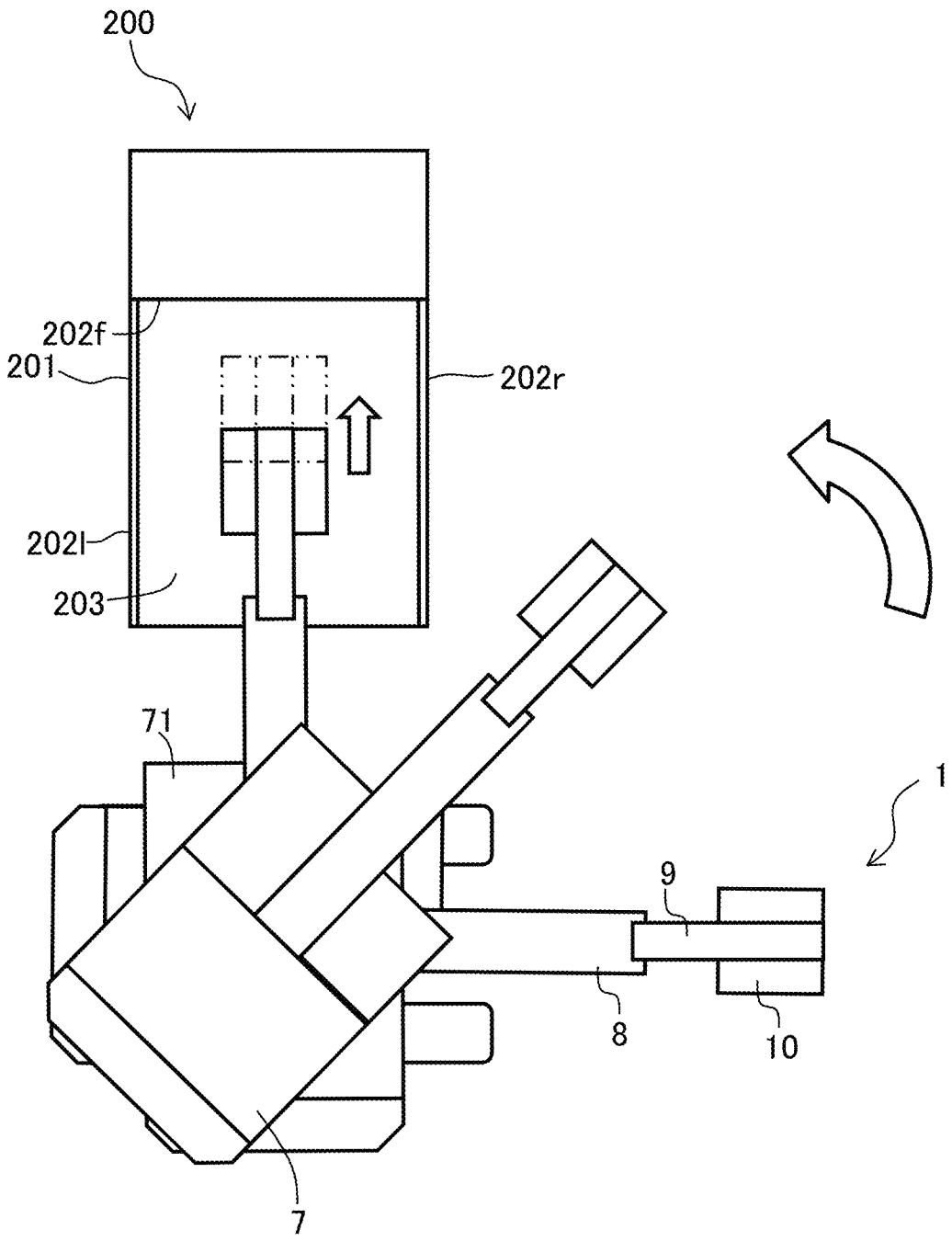
FIG. 12 is a diagram explaining the main operations of the hydraulic excavator 1.

Referring to FIG. 12, the main operations of the hydraulic excavator 1 according to the present embodiment will be explained. As shown in FIG. 12, when the operator starts a left swing operation to haul the excavated material to the to-be-loaded machine 200, the upper swing body 7 starts a left swing operation. If the tip height Zam of the arm is less than the passage lower limit height Zamta1, the left swing operation of the upper swing body 7 and the raising operation of the boom 8 are performed in combination. If the swing speed corresponding to the operator's left swing operation would cause the tip height Zam of the arm to fall below the lower limit defined by the correlation map Ma, the swing speed is automatically reduced.

When the work device 2 reaches at least the interference prevention position, the tip height Zam of the arm is positioned higher than the passage lower limit height Zamta1. This allows the bucket 10 to pass above the side part 202 of the bed 201 without interfering with the side part 202. When the entire bucket 10 is inside the bed 201, the operation of the arm 9 is effective. Thus, as shown by the dashed lines in FIG. 12, by performing a dump operation of the arm 9 and moving the tip of the arm 9 away from the cab 71, the discharge position of the excavated material can be adjusted. As a result, it is possible to improve the efficiency of the loading operation by the hydraulic excavator 1.

According to the first embodiment, the following operational effects are achieved.

(1) The controller 40 calculates a passing lower limit height (interference prevention height) Zamta1, which is the height of the tip of the arm 9 at which the work device 2 does not interfere with the bed (vessel) 201, based on the position of the bed (vessel) 201 obtained by the object position detection device (vessel position acquisition device) 54. The controller 40 determines whether the loading operation support control execution condition (interference prevention control execution condition), including the swing operation towards the direction in which the bucket 10 approaches the side part 202 of the loading platform 201, is satisfied. When it is determined that the loading operation support control execution condition (interference prevention control execution condition) is satisfied, the controller 40, based on the posture of the work device 2 detected by the posture detection device 53, identifies the operational start position, which is the circumferential position of the tip of the arm 9 when the loading operation support control execution condition (interference prevention control execution condition) is satisfied. The controller 40 identifies the interference prevention position, which is the angular position in the swing direction of the tip of the arm 9 that does not interfere with the bed 201 and the work device 2, between the operational start position and the side part 202 of the bed 201.

The controller 40 calculates the minimum height in the vertical direction of the work device 2 corresponding to the angular position in the swing direction of the tip of the arm 9, which becomes larger as it approaches the interference prevention position and reaches the passage minimum height (interference prevention height) Zamta1 at the interference prevention position, within the operating range of the upper swing body 7 from the identified operation start position to the interference prevention position (the operating range from the control start swing angle θswsa1 to the interference prevention angle θswta1). During the operation of the upper swing body 7 from the operation start position to the interference prevention position, the controller 40 disables the operation of the arm 9 by the operating device (arm operating device) 20 and controls the operation of the boom 8 and the upper swing body 7 so that the height of the tip of the arm 9 does not fall below the minimum value.

The controller 40 determines whether the conditions for enabling the operation of the arm 9, including the state where the tip of the arm 9 has reached a height exceeding the interference prevention position and has reached an angular position in the swing direction exceeding the interference prevention position, are met. If the enabling conditions are met, the controller 40 enables the operation of the arm 9 by the operating device (arm operating device) 20.

The controller 40 determines whether the bucket 10 has passed the side part 202 of the bed 201 in a plan view after swinging beyond the interference prevention position. If it is not determined that the bucket 10 has passed the side part 202 of the bed 201 in a plan view, the controller 40 controls the operation of at least one of the boom 8 and the arm 9 according to the operation of the arm 9 by the operating device (arm operating device) 20 so that the height of the tip of the arm 9 does not fall below the passage minimum height (interference prevention height) Zamta1. If it is determined that the bucket 10 has passed the side part 202 of the bed 201 in a plan view, the controller 40 allows the operation of the tip of the arm 9 to a position lower than the passage minimum height (interference prevention height) Zamta1.

According to this configuration, it is possible to provide a hydraulic excavator 1 that can prevent interference between the work device 2 and vessels such as the bed 201 of the to-be-loaded machine 200 during loading operations, and after the work device 2 has approached the side part 202 of the bed 201, the posture of the work device 2 can be adjusted reflecting the operator's intention.

(2) The conditions for executing the loading operation support control (interference prevention control execution conditions) include that the posture of the work device 2 is in the hauling posture. Based on the detection results of the posture detection device 53, the controller 40 determines whether the posture of the work device 2 is in the hauling posture or not.

If the condition that the posture of the work device 2 is in the hauling posture is not included in the conditions for executing the loading operation support control, there is a possibility that the loading operation support control may be executed contrary to the operator's intention during excavation operations, such as when the tip of the bucket 10 is pointing downward. Therefore, according to this embodiment, it is possible to execute the loading operation support control more in accordance with the operator's intention.

Second Embodiment

Referring to FIGS. 3 and 13 to 15, a hydraulic excavator 1 according to the second embodiment of the present invention will be described. The same reference numerals are assigned to the configurations that are the same or equivalent to those described in the first embodiment, and the differences are mainly described. The present invention is not limited to the loading operation support control as interference prevention control when performing loading operations described in the first embodiment. After the loading operation to the to-be-loaded machine 200, it may be executed that an interference prevention control is performed when preparing to move the work device 2 again towards the excavation site where the object to be excavated (such as the natural ground) exists. In the second embodiment, when the condition for executing the interference prevention control is met, an interference prevention control, which is a preparatory operation support control to prevent the bucket 10 from interfering with the bed 201 of the to-be-loaded machine 200 during the preparatory operation, is executed.

The preparatory operation starts from the situation where the entire bucket 10, in a plan view, is located inside the bed 201 of the to-be-loaded machine 200, and the dumping operation of the bucket 10 has been performed. In the second embodiment, the condition determination section 45 determines whether the condition for executing the preparatory operation support control, which is the condition for executing the second interference prevention control, is met. The condition for executing the preparatory operation support control includes at least the following Condition 1B.

[Condition 1B] In a plan view, a swing operation has been performed in which the bucket 10 moves from the inside of the bed 201 approaches the side part 202 of the bed 201.

The condition determination section 45 determines, based on the position of the bed 201 of the to-be-loaded machine 200 calculated by the to-be-loaded machine position calculation section 42 and the speed vector of the tip of the arm 9 calculated by the speed vector calculation section 44 (indicating the direction of movement of the bucket 10), whether a swing operation has been performed by the operator in which the bucket 10, in a plan view, moves from the inside of the bed 201 approaches the side part 202 of the bed 201 of the to-be-loaded machine 200.

Therefore, after the excavated material is discharged onto the bed 201, when the operator performs a swing operation towards the excavation site, the condition determination section 45 determines that the condition for executing the preparatory operation support control is met.

The method for determining whether a swing operation has been performed in which the bucket 10, in a plan view, moves from the inside of the bed 201 approaches the side part 202 of the bed 201 is not limited to this. For example, the condition determination section 45 may determine, based on the position of the bed 201 of the to-be-loaded machine 200 calculated by the to-be-loaded machine position calculation section 42, the position of the tip of the arm 9 calculated by the posture calculation section 41, and the direction of the swing operation detected by the operation detection part 56, whether a swing operation has been performed by the operator in which the bucket 10, in a plan view, moves from the inside of the bed 201 approaches the side part 202 of the bed 201 of the to-be-loaded machine 200.

Furthermore, the controller 40 may determine that the condition for executing the preparatory operation support control is met when it detects that the bucket 10 moves towards the side part 202 between the bucket 10 and the excavation site, according to the operator's operation. The operator can input the position of the excavation site to the controller 40 by operating an input device (not shown) having multiple switches.

The setting of the excavation site is not limited to manual setting by the operator. For example, the controller 40 may specify and store the position of the excavation site based on the change in posture of the work device 2 and the pressure of the hydraulic actuator when the posture of the work device 2 changes. The pressure of the hydraulic actuator is detected by a pressure sensor (not shown) and inputted to the controller 40.

When the preparatory operation support control execution condition is satisfied, the posture calculation section 41 shown in FIG. 3 calculates the swing angle θsw of the upper swing body 7 at the start of the preparatory operation support control (when the preparatory operation support control execution condition is satisfied) as the control start swing angle θswsb1 for specifying the operation start position. Furthermore, the posture calculation unit 41 calculates the height of the tip of the arm 9 at the start of the preparatory operation support control as the control start height Zamsb1.

When the preparatory operation support control execution condition is satisfied, the target angle calculation section 46 calculates the passage minimum height Zamtb1 based on the position (X, Y, Z coordinates) of the to-be-loaded machine 200's bed 201 in the excavator reference coordinate system, as calculated by the to-be-loaded machine position calculation unit 42. The passage minimum height Zamtb1 is calculated by adding the height Zv in the excavator reference coordinate system of the bed 201 and a predetermined setting value Za. In the loading operation, if there is no change in the position of the hydraulic excavator 1 and the loaded machine 200, the passage minimum height Zamtb1 may be set as the passage minimum height Zmata1 described in the first embodiment.

Furthermore, the posture calculation section 41 calculates the arm angle θam at the start of the preparatory operation support control as the control start arm angle θamsb1. When the preparatory operation support control execution condition is satisfied, the target angle calculation section 46 calculates, based on the control start arm angle θamsb1 and the passage minimum height Zamtb1, the passage minimum boom angle θbmtb1, which is the boom angle at which the arm tip height becomes the passage minimum height Zamtb1.

The target angle calculation section 46 calculates the lap swing angle θswtb based on the passage minimum boom angle θbmtb1, similar to the first embodiment. The target angle calculation section 46 calculates the interference prevention angle θswtb1, which specifies the interference prevention position between the specified operation start position inside the bed 201 and the side part 202 of the bed 201, by considering a predetermined margin to the lap swing angle θswtb. The lap swing angle θswtb corresponds to the position where the predicted movement trajectory L of the tip of the arm 9 intersects with the inner surface of the side part 202 of the bed 201 of the to-be-loaded machine 200 in plan view. The lap swing angle θswtb is the position (lap position) where the bucket 10 overlaps with the side part 202 of the bed 201 in plan view.

Furthermore, the target angle calculation section 46 calculates the outer-bed reach angle θswtb2. The outer-bed reach angle θswtb2 is the swing angle when the bucket 10 exceeds the side part 202 from inside the bed 201 and the entire bucket 10 is positioned outside the bed 201, by considering a predetermined margin to the lap swing angle θswtb.

Figure 13:
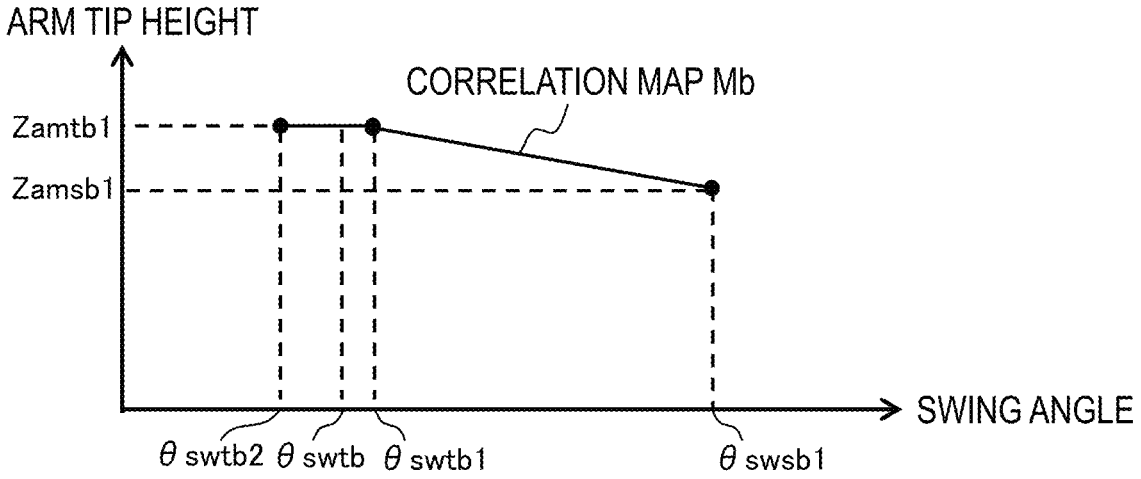
FIG. 13 is a diagram showing a correlation map Mb used by the controller according to the second embodiment during preparation operations.

The correlation map generation section 49 generates a correlation map Mb for use during preparatory operation support as shown in FIG. 13 based on the calculation results of the target angle calculation section 46 and stores it in the storage device. The horizontal axis of the correlation map Mb shown in FIG. 13 indicates the swing angle. The correlation map Mb is a map in which the swing angle increases with leftward swinging from the reference posture with the swing angle at 0 degrees, that is, a map in which the swing angle decreases when returning to the reference posture after leftward swinging.

The correlation map Mb is generated such that from the control start swing angle θswsb1 to the interference prevention angle θswtb1, the minimum value of the arm tip height monotonically increases with the decrease in swing angle from the control start height Zamsb1, and by the interference prevention angle θswtb1, the minimum value of the arm tip height becomes the passage minimum height Zamtb1. Furthermore, the correlation map Mb is generated such that the lower limit value of the arm tip height becomes the passing lower limit height Zamtb1 from the interference prevention angle θswtb1 to the outer-bed reach angle θswtb2.

The posture comparison section 47, as shown in FIG. 3, compares the arm tip height Zam calculated by the posture calculation section 41 with the passing lower limit height Zamtb1 calculated by the target angle calculation section 46. The posture comparison section 47, based on the result of this comparison, determines whether the activation condition for the operation of arm 9 has been met. In the second embodiment, the activation condition for the operation of arm 9 is met when the tip of arm 9 exceeds the passing lower limit height (interference prevention height) Zamtb1.

The posture comparison section 47 determines that the tip of arm 9 has not exceeded the passing lower limit height (interference prevention height) Zamtb1 when the arm tip height Zam is equal to or less than the passing lower limit height (interference prevention height) Zamtb1. In other words, the posture comparison section 47 determines that the activation condition has not been met.

The posture comparison section 47 determines that the tip of arm 9 has exceeded the passing lower limit height (interference prevention height) Zamtb1 when the arm tip height Zam is greater than the passing lower limit height (interference prevention height) Zamtb1. In other words, the posture comparison section 47 determines that the activation condition has been met.

Figure 14:
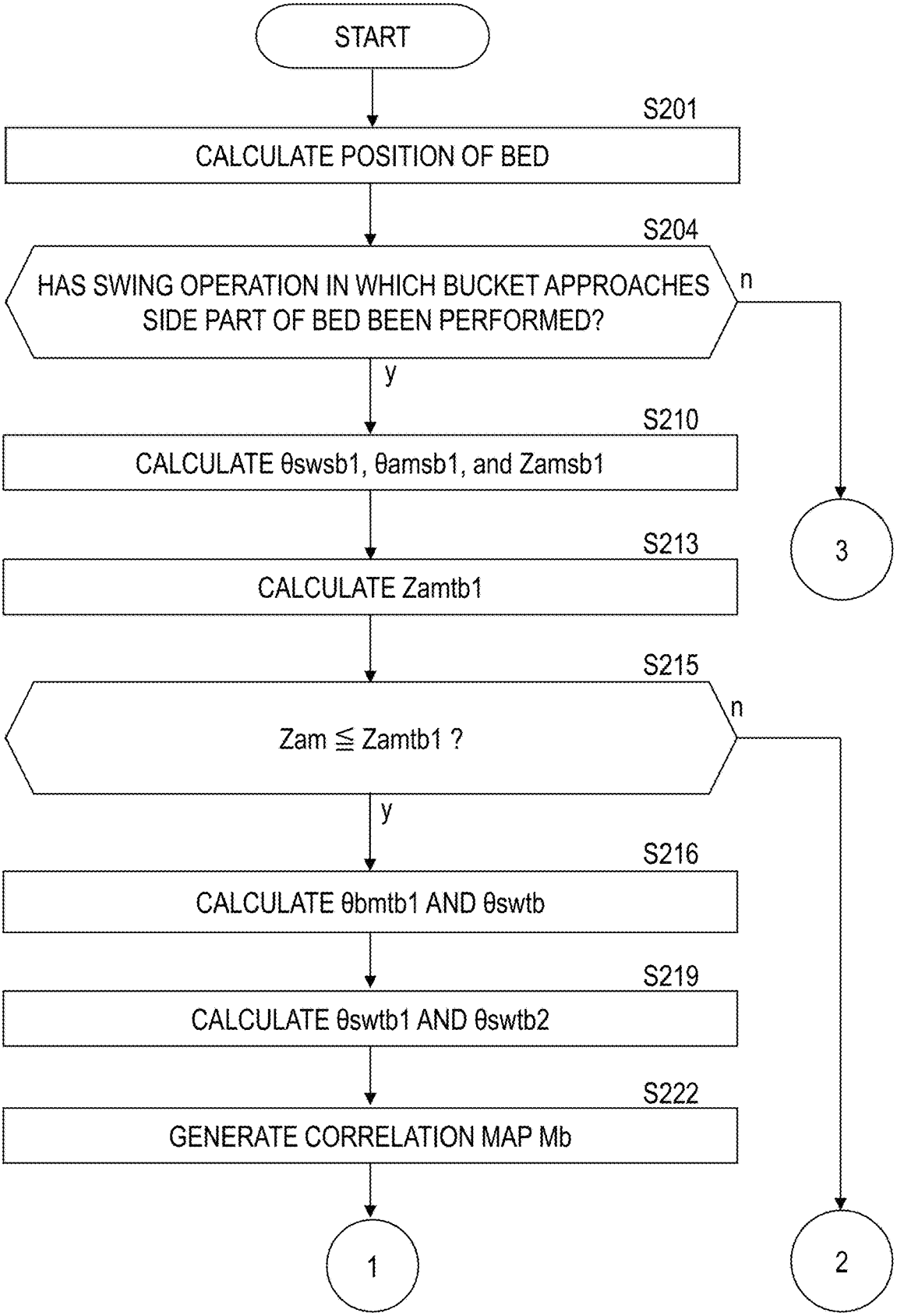
FIG. 14 is a flowchart showing an example of the process flow of preparation operation support control executed by the controller according to the second embodiment, showing the processes from step S201 to S222.

The process flow of the preparatory operation support control executed by the controller 40, as explained with reference to FIGS. 14 and 15, is an example. FIGS. 14 and 15 are flowcharts showing an example of the process flow of the preparatory operation support control executed by the controller 40, similar to FIGS. 10 and 11. The explanation of processes in the flowcharts of FIGS. 14 and 15 that are similar to those shown in the flowcharts of FIGS. 10 and 11 is omitted as appropriate. The processes shown in the flowcharts of FIGS. 14 and 15 start when the ignition switch (not shown) is turned on and are executed repeatedly at a predetermined control cycle.

As shown in FIG. 14, at step S201, the to-be-loaded machine position calculation section 42 calculates the relative position of the to-be-loaded machine 200's bed 201 to the hydraulic excavator 1 based on the detection results of the object position detection device 54.

At the next step S204, the condition determination section 45 determines, based on the position of the bed 201 calculated at step S201 and the speed vector of the arm tip calculated by the speed vector calculation section 44, whether the operator has performed a swing operation in the direction from the inside of the bed 201 approaches the side part 202 of the bed 201 in a plan view.

If it is determined at step S204 that the operator has performed a swing operation in the direction from the inside of the bed 201 approaches the side part 202 of the bed 201 in a plan view, the process proceeds to step S210. If it is determined at step S204 that the operator has not performed the swing operation in the direction from the inside of the bed 201 approaches the side part 202 of the bed 201 in a plan view, the process shown in the flowcharts of FIGS. 14 and 15 ends.

When a positive determination is made in the determination process at step S204, the preparatory operation support control execution condition is met, and the preparatory operation support control starts. In the preparatory operation support control, first, at step S210, the posture calculation section 41 calculates the control start swing angle θswsb1, the control start arm angle θamsb1, and the control start height Zamsb1.

At the next step S213, the target angle calculation section 46 calculates the passage lower limit height Zamtb1. At the next step S215, the posture comparison section 47 determines whether the current arm tip height Zam calculated by the posture calculation section 41 is equal to or less than the passage lower limit height Zamtb1 calculated at step S213. If it is determined at step S215 that the current arm tip height Zam is equal to or less than the passage lower limit height Zamtb1, the process proceeds to step S216. If it is determined at step S215 that the current arm tip height Zam is greater than the passage lower limit height Zamtb1, the condition for enabling the operation of the arm 9 is met, and the process proceeds to step S245.

At step S216, the target angle calculation section 46 calculates the passage lower limit boom angle θbmtb1 and the lap swing angle θswtb. At the next step S219, the target angle calculation section 46 calculates the interference prevention angle θswtb1 and the outer-bed reach angle θswtb2.

At the next step S222, the correlation map generation section 49 generates a correlation map Mb (refer to FIG. 13) based on the calculation results at steps S210, S213, S219.

If a positive determination is made in the determination process at step S215, the condition for executing automatic boom raising control is met. As a result, as shown in FIG. 15, at step S231, the target speed calculation section 48 sets the target speed of the boom cylinder 11 to a predetermined automatic boom raising speed. Once the process at step S231 is completed, the process proceeds to step S234.

At step S234, the target speed calculation section 48 determines whether the arm tip height Zam falls below the lower limit defined by the correlation map Mb based on the swing speed ωsw in response to the operator's swing operation and the limited swing speed ωswt. If it is determined at step S234 that the arm tip height Zam falls below the lower limit defined by the correlation map Mb due to the operator's swing operation, the process proceeds to step S237. If it is determined at step S234 that the arm tip height Zam does not fall below the lower limit defined by the correlation map Mb due to the operator's swing operation, the process proceeds to step S240.

At step S237, the target speed calculation section 48 sets the target speed of the swing hydraulic motor 6 to a speed corresponding to the limited swing speed ωswt. The processes at steps S231, S237 ensure that the swing operation and the boom raising operation are combined so that the arm tip height does not fall below the lower limit defined by the correlation map Mb. Although not shown, if a negative determination is made at step S234, the target speed of the swing hydraulic motor 6 is set according to the operation command speed corresponding to the operator's swing operation amount. Once the process at step S237 is completed, the process proceeds to step S240.

The processes at steps S240, S243 are the same as those shown in steps S140, S143 in FIG. 11, and thus the explanation thereof is omitted.

As shown in FIG. 15, at step S245, the target angle calculation section 46 performs the same processing as in step S240. If it is determined at step S245 that there is arm operation by the operator, the process proceeds to step S247. If it is determined at step S245 that there is no arm operation by the operator, the process proceeds to step S250.

At step S247, the target angle calculation section 46 recalculates the outer-bed reach angle θswtb2, and the correlation map generation section 49 updates the correlation map Mb. Once the processing at step S247 is completed, the process proceeds to step S250.

At step S250, the posture comparison section 47 determines, based on the current swing angle θsw calculated by the posture calculation section 41 and the outer-bed reach angle θswtb2, whether the entire bucket 10 has reached outside of the bed 201 in a plan view. If it is determined at step S250 that the entire bucket 10 has not reached outside of the bed 201 in a plan view, the process proceeds to step S253. If it is determined at step S250 that the entire bucket 10 has reached outside of the bed 201 in a plan view, the processing shown in the flowcharts of FIGS. 14 and 15 is completed.

At step S253, the target speed calculation section 48 determines, based on the speed vector of the arm tip calculated by the speed vector calculation section 44, whether the arm tip height Zam falls below the lower limit (passage lower limit height Zamtb1) defined by the correlation map Mb due to the operator's arm operation. If it is determined at step S253 that the arm tip height Zam falls below the lower limit defined by the correlation map Mb due to the operator's arm operation, the process proceeds to step S256. If it is determined at step S253 that the arm tip height Zam does not fall below the lower limit defined by the correlation map Mb due to the operator's arm operation, the process proceeds to step S260.

At step S256, the target speed calculation section 48 calculates the target speed of the boom cylinder 11 for raising the boom 8 so that the arm tip height Zam does not fall below the lower limit defined by the correlation map Mb. Thus, the arm operation and the boom raising operation are combined so that the arm tip height does not fall below the passage lower limit height Zamtb1. Once the processing at step S256 is completed, the process proceeds to step S260.

The processing at steps S260, S263, and S266 is the same as the processing at steps S160, S163, and S166 in FIG. 11. As shown in FIG. 15, if an affirmative determination is made at step S263, the process proceeds to step S269. Also, if an affirmative determination is made at step S266, the process proceeds to step S269.

At step S269, the posture comparison section 47 performs the same processing as in step S215. If it is determined at step S269 that the current arm tip height Zam is equal to or less than the passage lower limit height Zamtb1, the process returns to step S231. If it is determined at step S269 that the current arm tip height Zam is greater than the passage lower limit height Zamtb1, the condition for enabling the operation of the arm 9 is met, and the process proceeds to step S245.

Thus, in the second embodiment, by the controller 40 assisting with the preparation operation, after the discharge operation of the object onto the bed 201 is completed, it is possible to prevent interference between the bucket 10 and the side part 202 of the bed 201 when performing the preparation operation from a situation where the bucket 10 is positioned lower than the upper edge of the side part 202 of the bed 201. If, at the start of the preparation operation support control, the bucket 10 is positioned higher than the upper edge of the side part 202 of the bed 201, assistance by the controller 40 can be provided only for operations by the operator that may cause interference. Furthermore, when the bucket 10 is positioned outside the bed 201, beyond the side part 202, operations of the tip of the arm 9 to positions lower than the interference prevention height Zamtb1 are permitted, allowing the bucket 10 to be quickly brought closer to the excavation target and transition to the excavation operation.

In the preparation operation, the height of the arm tip often exceeds the interference prevention height at the start of the operation or immediately after the start of the operation. In this second embodiment, by setting the activation condition to include the condition that the tip of the arm 9 exceeds the interference prevention height, it is possible to immediately enable the operation of the arm 9 after the start of the preparation operation. This allows the preparation operation for the excavation work to be performed more in accordance with the operator's intention.

Third Embodiment

Referring to FIGS. 3 and 16 to 18, the hydraulic excavator 1 according to the third embodiment of the present invention is described. The same reference numbers are assigned to the configurations that are the same or equivalent to those described in the first embodiment, and the differences are mainly described. In the first embodiment, an example was described where the loading operation support control ends when the entire bucket 10 reaches inside the bed 201 in plan view, and the operator is free to operate the arm 9. In contrast, in the third embodiment, the loading operation support control continues even after the entire bucket 10 has reached inside the bed 201 in plan view. The control content by the controller 40 of the hydraulic excavator 1 according to the third embodiment is described in detail below.

The controller 40 according to the third embodiment sets the vessel internal minimum height (inner-vessel minimum value) Zamta2 (refer to FIG. 17), which is the height position of the tip of the arm 9 where the bucket 10 does not contact the bottom 203 of the bed 201 within the to-be-loaded machine 200.

Figure 16:
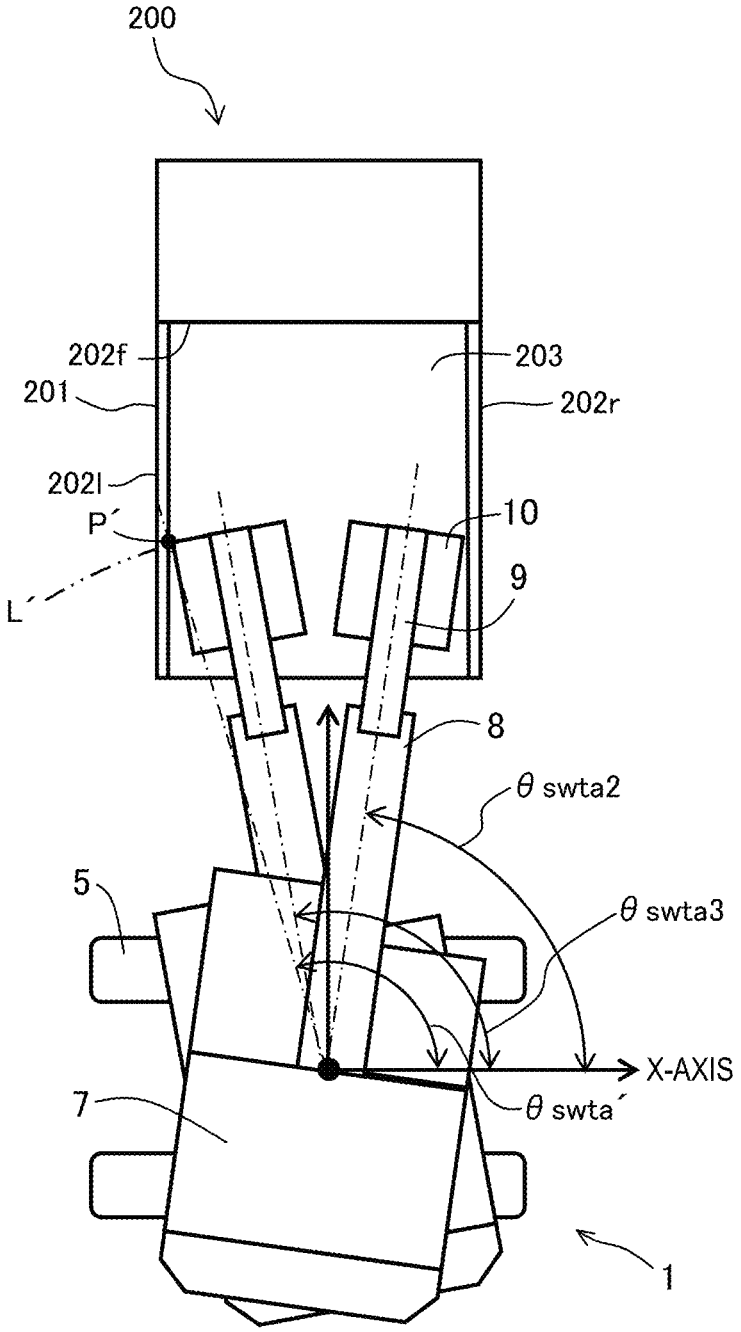
FIG. 16 is a plan view of the hydraulic excavator and the machine to be loaded, showing the cargo bed internal limit angle θswta3.

The target angle calculation section 46, as shown in FIG. 3, calculates the arm tip distance Rta1 based on the calculation results of the posture calculation section 41. As shown in FIG. 16, the target angle calculation section 46 calculates the position in the excavator reference coordinate system of the intersection point P' between the predicted movement trajectory L' of the tip of the arm 9 when rotated with the arm tip distance Rta1 and the line representing the inner surface of the side part 202*l* of the bed 201. Based on the position of point P', the target angle calculation section 46 calculates the lap swing angle θswta'.

As shown in FIG. 8, the lap swing angle θswta is the swing angle when the work device 2 is positioned at the position (point P) where the predicted movement trajectory L of the tip of the arm 9 overlaps with one of the pair of side parts 202 (for example, the right side part 202*r*). In response, as shown in FIG. 16, the lap swing angle θswta' is the swing angle when the work device 2 is positioned at a location (point P') where the predicted movement trajectory L' of the tip of the arm 9 overlaps with one of the pair of left and right side parts 202 (for example, the left side part 202*l*).

The target angle calculation section 46 calculates the inner-bed limit angle θswta3 by adding a predetermined margin θswtam' to the lap swing angle θswta' (θswta3=θswta'+θswtam'). The predetermined margin θswtam' is added so that the entire bucket 10 fits inside the bed 201 in a plan view, at a position where the work device 2 moves away from the side part 202*l* towards the inside of the bed 201. For example, if the lap swing angle θswta' in the left swing direction from the standard posture is represented by a positive value, the margin θswtam' will be a negative value. The absolute value of the margin is greater than at least half the width of the bucket 10.

The inner-bed reach angle θswta2 and the inner-bed limit angle θswta3 represent the swing angles within which the entire bucket 10 can be positioned inside the bed 201 in a plan view.

Figure 17:
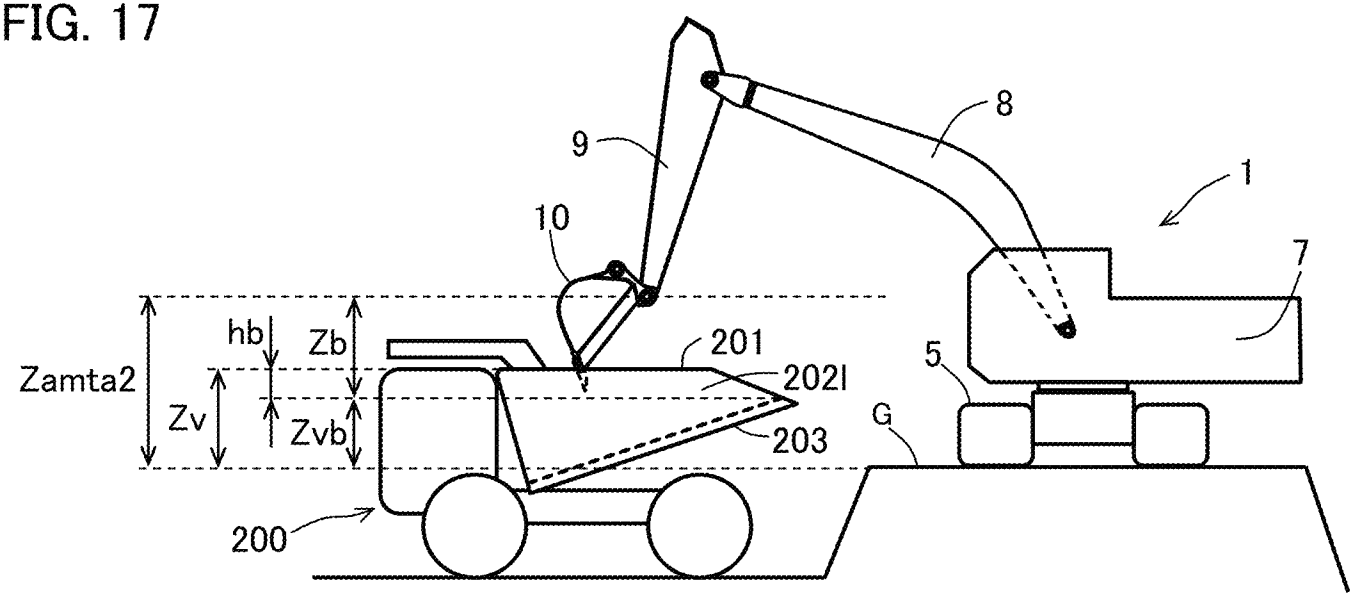
FIG. 17 is a side view of the hydraulic excavator and the machine to be loaded, showing the vessel internal lower limit height Zamta2.

As shown in FIG. 17, the target angle calculation section 46 calculates the bottom plate height Zvb by subtracting the height hb from the height Zv of the bed 201 in the excavator reference coordinate system, which is calculated by the to-be-loaded machine position calculation section 42. The height hb is the height from the bottom 203 to the upper edge of the bed 201. The target angle calculation section 46 calculates the inner-vessel lower limit height Zamta2 by adding a predetermined set value Zb to the bottom plate height Zvb. In the case that the bottom 203 is inclined relative to the horizontal, the height hb is set to the minimum value hbmin of the height from the bottom 203 to the upper edge of the bed 201. Furthermore, the height hb is not limited to a fixed value. In this case, the target angle calculation section 46 calculates the height hb based on the positional relationship between the bucket 10 and the bed 201. The set value Zb is determined by adding the bucket length Lbk and a margin.

Figure 18:
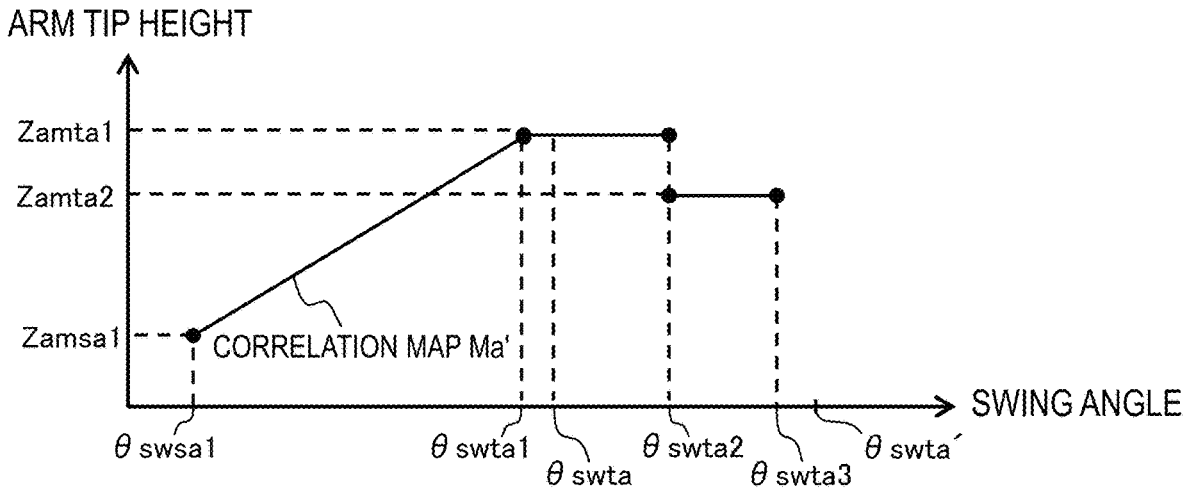
FIG. 18 is a diagram showing a correlation map Ma' used by the controller according to the third embodiment during loading operations.

The correlation map generation section 49 generates and stores in a storage device a correlation map Ma' for loading operation support as shown in FIG. 18, based on the calculation results of the target angle calculation section 46. As shown in FIG. 18, the correlation map Ma' is the same as the correlation map Ma (refer to FIG. 6) described in the first embodiment from the control start swing angle θswsa1 to the inner-bed reach angle θswta2. The correlation map Ma' differs from the correlation map Ma (refer to FIG. 6) described in the first embodiment in that a lower limit value for the arm tip height is set in the range from the inner-bed reach angle θswta2 to the inner-bed limit angle θswta3. The correlation map Ma' is generated such that the lower limit value of the arm tip height from the inner-bed reach angle θswta2 to the inner-bed limit angle θswta3 becomes the lower limit height Zamta2 inside the vessel.

The target speed calculation section 48 calculates the target speed in the extension direction of the boom cylinder 11 (the lifting direction of the boom 8) so that the arm tip height Zam does not fall below the inner-vessel lower limit height Zamta2, when the swing angle θsw is within the range from the inner-bed reach angle θswta2 to the inner-bed limit angle θswta3, namely, when the bucket 10 is moving between the right side part (first side part) 202*r* and the left side part (second side part) 202*l* inside the bed 201 after passing through the right side part (first side part) 202*r*. The target speed calculation section 48 may, instead of calculating the target speed in the extension direction of the boom cylinder 11, or in addition to calculating the target speed in the extension direction of the boom cylinder 11, set the target speed of the arm cylinder 12 to 0 (zero). This prevents interference between the bucket 10 and the bed 201 of the to-be-loaded machine 200 after the bucket 10 has reached inside the bed 201.

Thus, the controller 40 of the hydraulic excavator 1 according to the third embodiment allows the operation of the tip of the arm 9 to a position lower than the interference prevention height Zamta1, if it is determined that the bucket 10 has overlapped with the right side part (first side part) 202*r* and then continued to swing until they no longer overlap (the entire bucket 10 has passed the side part 202*r*). Furthermore, the controller 40 sets a inner-vessel lower limit height (inner-vessel lower limit value) Zamta2, which is the height position of the tip of the arm 9 where the bottom 203 and the bucket 10 do not contact, between the right side part (first side part) 202*r* and the left side part (second side part) 202*l*. Then, when the bucket 10 is moving between the right side part (first side part) 202*r* and the left side part (second side part) 202*l* inside the bed 201, passing through the right side part (first side part) 202*r*, the controller 40 controls the operation of at least one of the boom 8 and the arm 9 so that the height of the tip of the arm 9 (tip height of the arm) Zam does not fall below the inner-vessel lower limit height Zamta2.

According to this configuration, after the entire bucket 10 is placed inside the bed 201 during the loading operation, interference between the bucket 10 and the bottom 203 of the bed 201 can be appropriately prevented.

Various modifications are within the scope of the present invention, and it is possible to combine the configurations described in the above embodiments, combine the configurations described in different embodiments, and combine the configurations described in the following different modifications.

Modification Example 1

In the first embodiment, the conditions for executing the loading operation support control were explained as including: [Condition 1] a swing operation in the direction approaching the side part 202 of the bed 201 from outside in a plan view; and [Condition 2] the posture of the work device 2 being in a hauling posture. But the present invention is not limited to this. The conditions for executing the loading operation support control may at least include "a swing operation in the direction approaching the side part 202 of the bed 201." Furthermore, additional conditions may be added to the conditions for executing the loading operation support control.

Modification Example 1-1

Figure 19A:
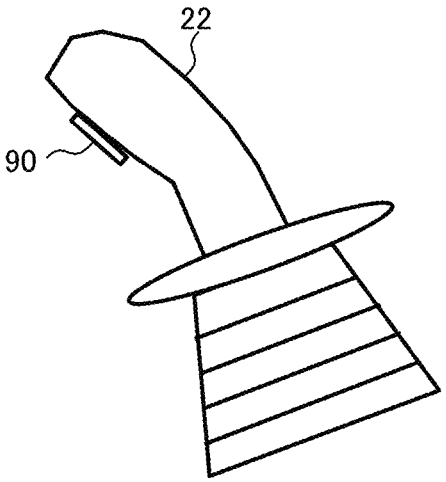
FIG. 19A is a diagram showing an example of the arrangement of the support control execution switch.
Figure 19B:
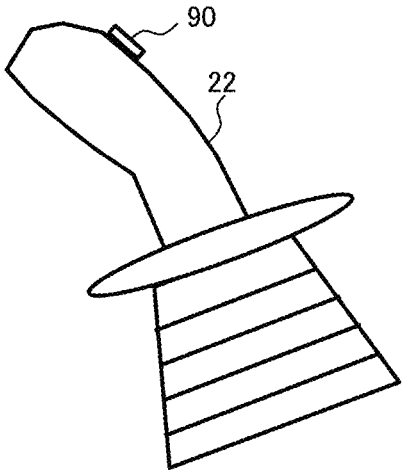
FIG. 19B is a diagram showing another example of the arrangement of the support control execution switch.
Figure 20:
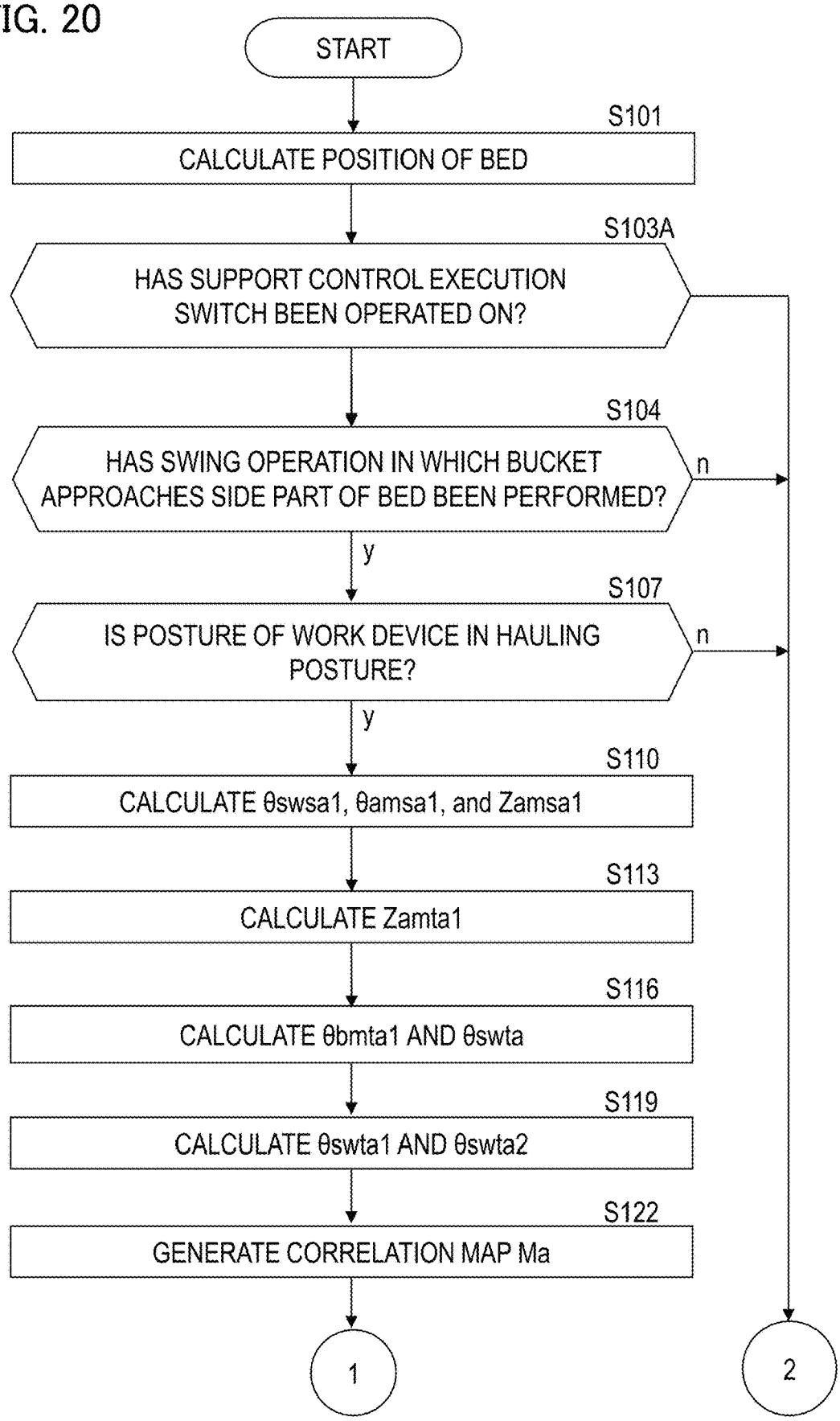
FIG. 20 is a flowchart showing the process flow of loading operation support control executed by the controller according to modification example 1-1.

Referring to FIGS. 19A, 19B, and 20, a modification example 1-1 is described, which adds the following Condition A to the loading operation support control execution conditions explained in the first embodiment. In this modification example 1-1, the conditions for executing the loading operation support control are established when all of Condition 1, Condition 2, and Condition A are satisfied, and are not established if any of Condition 1, Condition 2, and Condition A are not satisfied.

[Condition A] The support control execution switch 90 is turned on.

FIG. 19A is a diagram showing an example of the arrangement of the support control execution switch 90, and FIG. 19B is a diagram showing another example of the arrangement of the support control execution switch 90. As shown in FIGS. 19A and 19B, the support control execution switch 90 is, for example, provided on the operation lever 22.

In the example shown in FIG. 19A, the support control execution switch 90 is provided on the front side of the operation lever 22. With this configuration, the operator can easily operate the support control execution switch 90 with a finger such as the index finger while gripping and operating the operation lever 22.

In the example shown in FIG. 19B, the support control execution switch 90 is provided on the rear side of the operation lever 22. With this configuration, the operator can easily operate the support control execution switch 90 with a finger such as the thumb while gripping and operating the operation lever 22.

The support control execution switch 90 is switched to the on position by being pressed from the off position. In the operation mode of the support control execution switch 90, it may be a momentary operation mode or an alternate operation mode. The support control execution switch 90 outputs an off signal to the controller 40 when in the off position, and outputs an on signal to the controller 40 when in the on position.

In the present modification example 1-1, the loading operation support control shown in FIGS. 20 and 11 is executed. FIG. 20 is a flowchart with the processing of step S103A added between step S101 and step S104 in the flowchart of FIG. 10.

In the present modification example 1-1, when the processing of step S101 is completed, the process proceeds to step S103A. At step S103A, the condition determination section 45 determines whether the support control execution switch 90 has been operated on or not. If it is determined at step S103A that the support control execution switch 90 has been operated on (pressed), the process proceeds to step S104. If it is determined at step S103A that the support control execution switch 90 has not been operated on, the processing shown in the flowcharts of FIGS. 20 and 11 is terminated.

According to the present modification example 1-1, since the loading operation support control execution condition includes Condition A, the operator can execute or cancel the loading operation support control at any timing. As the loading operation support control is executed more in accordance with the operator's intention, the efficiency of the loading work can be further improved.

In the present modification example 1-1, an example in which Condition A is included in the loading operation support control execution condition has been described, but Condition A may also be included in the preparation operation support control execution condition described in the second embodiment. Condition A may also be included in the loading operation support control execution condition described in the third embodiment.

Modification Example 1-2

Next, with reference to FIGS. 21 and 22, a description will be given of Modification Example 1-2 in which the following Condition B is added to the loading operation support control execution condition described in the first embodiment.

In the present modification example 1-2, the loading operation support control execution condition is established when all of Condition 1, Condition 2, and Condition B are satisfied, and is not established if any of Condition 1, Condition 2, and Condition B are not satisfied.

[Condition B] There is a to-be-hauled object (excavated material) inside the bucket 10.

Figure 21:
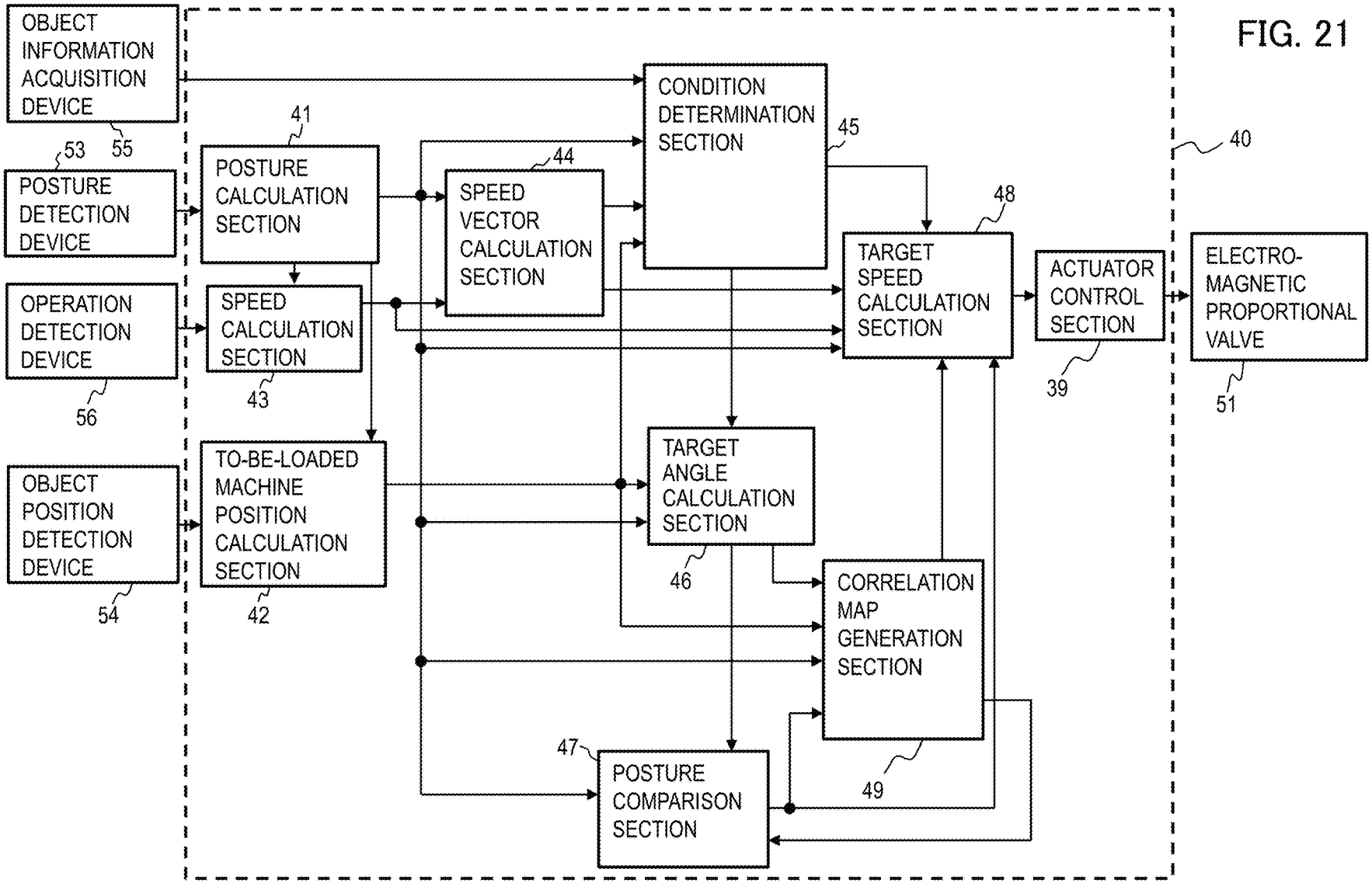
FIG. 21 is a functional block diagram of the controller according to modification example 1-2.

As shown in FIG. 21, the hydraulic excavator 1 according to the present modification example 1-2 includes an object information acquisition device 55 for acquiring information on the to-be-hauled object inside the bucket 10. The object information acquisition device 55 is, for example, a device for acquiring the load of the object (cargo) inside the bucket 10. The object information acquisition device 55 is, for example, a weight detection device comprising a pressure sensor configured to detect the pressure of the boom cylinder 11 and a controller configured to calculate the weight of the object inside the bucket 10 based on the detection result of the pressure sensor.

The condition determination section 45 compares the weight W of the object inside the bucket 10 obtained by the object information acquisition device 55 with the weight threshold WO. The weight threshold WO is predetermined by experiments or the like and stored in the storage device of the controller 40. The weight threshold WO corresponds to the weight of the to-be-hauled object that is sufficient for the hauling operation to be performed.

Figure 22:
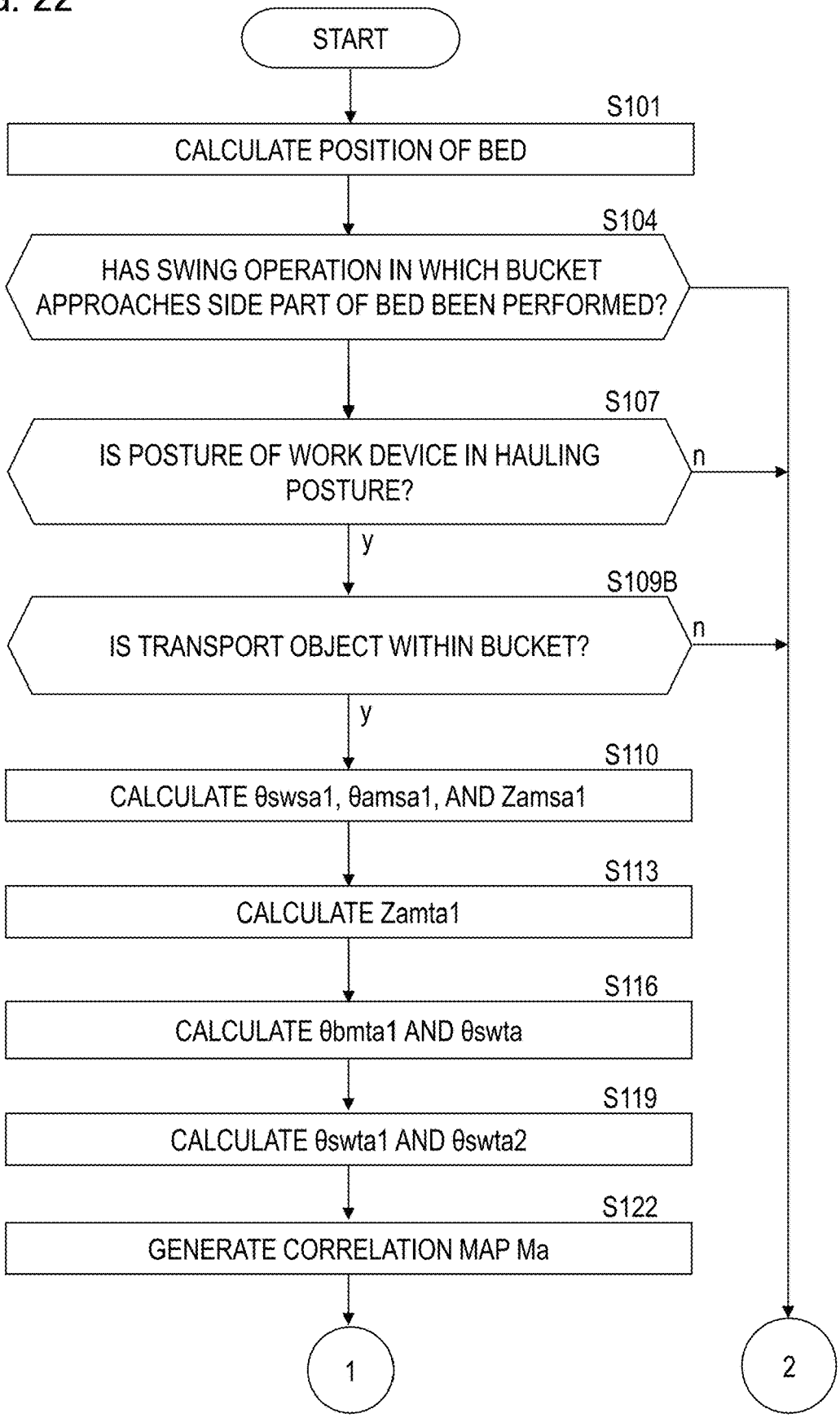
FIG. 22 is a flowchart showing the process flow of loading operation support control executed by the controller according to modification example 1-2.

In the present modification example 1-2, the loading operation support control shown in FIGS. 22 and 11 is executed. FIG. 22 is a flowchart in which the process of step S109B is added between step S107 and step S110 in the flowchart of FIG. 10.

In the present modification example 1-2, if an affirmative determination is made at step S107, the process proceeds to step S109B. At step S109B, the condition determination section 45 determines whether or not a to-be-hauled object exists within the bucket 10 based on the weight W acquired by the object information acquisition device 55. At step S109B, if the condition determination section 45 determines that the weight W acquired by the object information acquisition device 55 is greater than the weight threshold WO, it is determined that a transport object exists within the bucket 10, and the process proceeds to step S110. At step S109B, if the condition determination section 45 determines that the weight W acquired by the object information acquisition device 55 is equal to or less than the weight threshold WO, it is determined that no transport object exists within the bucket 10, and the process shown in the flowcharts of FIGS. 22 and 11 is terminated.

Thus, in the present modification example 1-2, the condition for executing interference prevention control includes "the existence of a to-be-hauled object within the bucket 10." The controller 40 determines whether or not a transport object exists within the bucket 10 based on the information (weight) acquired by the object information acquisition device 55. According to the present modification example 1-2, it is possible to more accurately determine whether or not the operator intends to perform a transport operation. Since it is possible to more accurately grasp the operator's intention, it is possible to support the loading operation without causing discomfort to the operator. As a result, the efficiency of the loading operation can be further improved.

The object information acquisition device 55 is not limited to a weight detection device that detects the weight of an object within the bucket 10. The object information acquisition device 55 may be composed of an imaging device such as a camera that captures the bucket 10, and an image recognition controller that recognizes an object from the image captured by the imaging device. The controller 40 determines whether or not a transport object exists within the bucket 10 based on the information (image) of the transport object within the bucket 10 acquired by the object information acquisition device.

Modification Example 2

In the first embodiment, an example was described in which the lap swing angle θswta, in which the work device 2 overlaps the side part 202 of the bed 201 in plan view, is calculated, a margin θswtam considering the width of the bucket 10 is added to the lap swing angle θswta, and the interference prevention angle θswta1 is calculated. However, the method of calculating the interference prevention angle θswta1 is not limited to this method. For example, theoretically, a standard prevention angle θswta0 that can prevent interference between the bed 201 and the bucket 10 may be calculated by the following equation (5). An interference prevention angle θswta1 may be calculated by adding a predetermined margin to the standard prevention angle θswta0 calculated by equation (5).

[Math. 5]

$$\theta_{swta0} = \tan^{-1}\left(\frac{Y_{ta1}}{X_{ta1}}\right) - \tan^{-1}\left(\frac{W_{bk}/2}{R_{ta1}}\right) \tag{5}$$

Wbk is the width of the bucket 10, and Rta1 is the arm tip distance calculated by equation (3). Xta1, Yta1 are the position coordinates of the intersection between the predicted movement trajectory of the tip of the arm 9 when it is swinged with the arm tip distance Rta1 and the line indicating the side part 202 of the bed 201.

Instead of the arm tip distance Rta1 described in the above embodiment, various calculations may be performed using the distance (hereinafter, also referred to as bucket tip distance) Rta1*a* from the swing center axis (Z-axis) to the tip of the bucket 10 when viewed in plan. The bucket tip distance Rta1*a* is determined by the following equation (6).

[Math. 6]

$$R_{ta1a} = L_{ox} + L_{bm}\cos\theta_{bmta1} + L_{am}\cos(\theta_{bmta1} + \theta_{am}) + L_{bk}\cos(\theta_{bmta1} + \theta_{am} + \theta_{bk}) \tag{6}$$

θbk is the bucket angle calculated by the posture calculation section 41, and θam is the arm angle calculated by the posture calculation section 41. θbmta1 is the minimum passing boom angle determined by equation (2). Lox is the distance (offset) from the swing center axis (Z-axis) to the boom pin 8*a*, Lbm is the boom length, Lam is the arm length, and Lbk is the bucket length.

The reference prevention angle θswta0 is determined by the following equation (7) using the bucket tip distance Rta1*a*.

[Math. 7]

$$\theta_{swta0} = \tan^{-1}\left(\frac{Y_{ta1a}}{X_{ta1a}}\right) - \tan^{-1}\left(\frac{W_{bk}/2}{R_{ta1a}}\right) \tag{7}$$

Xta1*a*, Yta1*a* are the position coordinates of the intersection between the predicted movement trajectory of the tip of the bucket 10 when performing a swing operation with the bucket tip distance Rta1*a* and the side part 202 of the bed 201.

By applying the calculation method of this modification example 2, it is possible to calculate the interference prevention angles θswta1, θswtb1, the inner-bed reach angle θswta2, the outer-bed reach angle θswtb2, and the inner-bed limit angle θswta3 more accurately than in the above embodiment.

Modification Example 3

In the first embodiment, the condition for enabling the operation of the arm 9 was explained as being valid only when the tip of the arm 9 exceeds the interference prevention position in the swing direction, that is, when the swing angle θsw exceeds the interference prevention angle θswta1. However, the present invention is not limited to this. In the first embodiment, the condition for enabling the operation of the arm 9 may also be established when the tip of the arm 9 exceeds the interference prevention height (minimum passing height) in addition to when it exceeds the interference prevention position in the swing direction.

Figure 23:
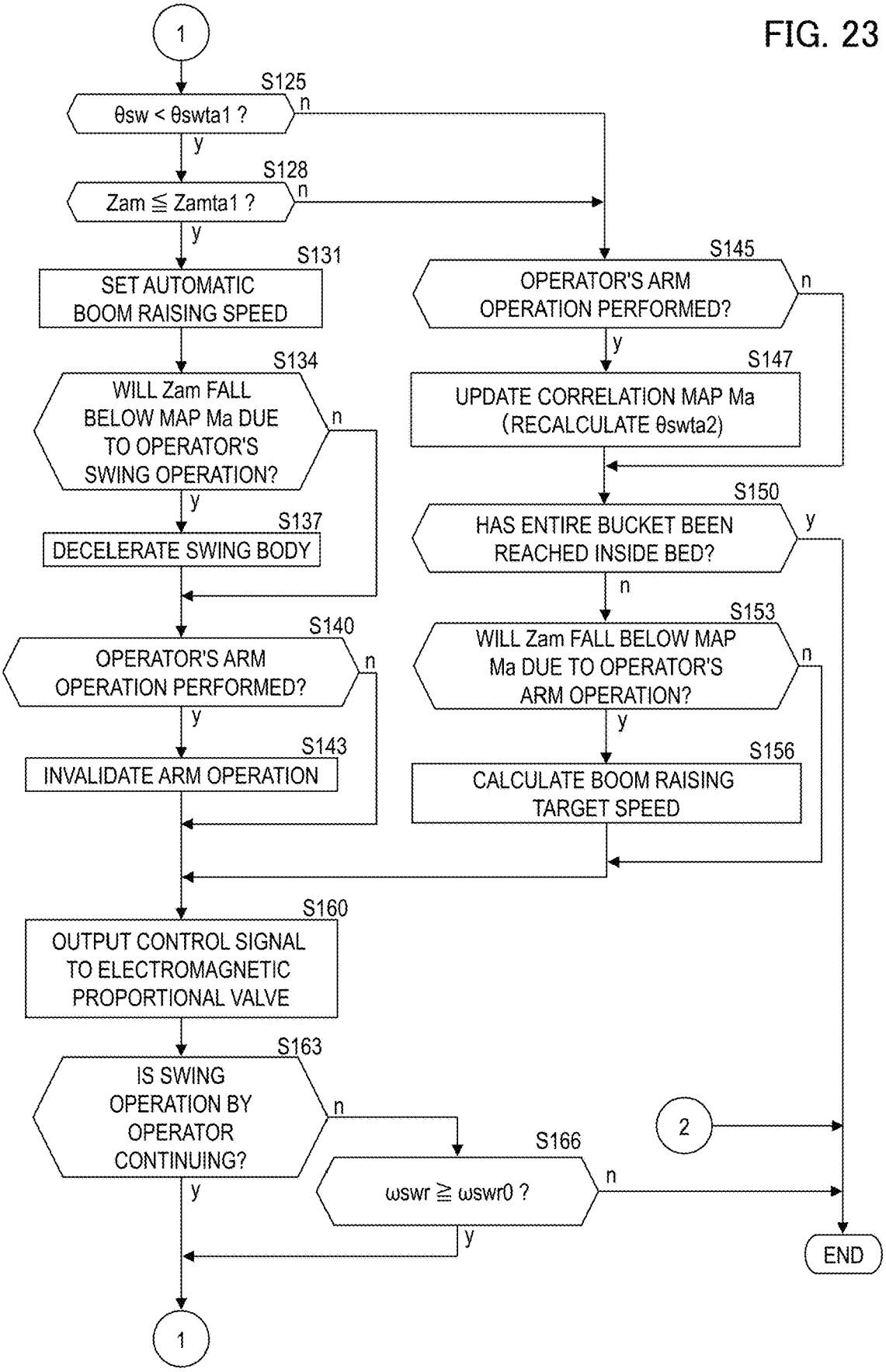
FIG. 23 is a flowchart showing an example of the process flow of loading operation support control executed by a controller according to modification example 3, and shows the processing from step S125 to S166.

Hereinafter, with reference to FIG. 23, an example of the processing flow of the loading operation support control executed by the controller 40 according to this modification example 3 will be described. This modification example 3 is a variation of the first embodiment, and the differences from the first embodiment will be explained. FIG. 23 is a flowchart showing an example of the processing flow of the loading operation support control executed by the controller 40 related to this modification example 3, illustrating the processing from step S125 to S166. The flowchart of FIG. 23 differs from the flowchart of FIG. 11 in the processing executed when a negative determination is made at step S128. In the flowchart of FIG. 11, if a negative determination is made at step S128, the process proceeds to step S134. In contrast, in the flowchart of FIG. 23, if it is determined at step S128 that the current arm tip height Zam is greater than the minimum passing height Zamta1, the process proceeds to step S145.

According to this configuration, if the operator's swing operation amount is small and the arm tip height Zam becomes greater than the minimum passing height Zamta1 before the swing angle θsw reaches the interference prevention angle θswta1 due to automatic boom raising, the operation of the arm 9 becomes effective. Such a modification example can achieve the same effects as the first embodiment. In the case of slowly operating the upper swing body 7, even before the swing angle θsw reaches the interference prevention angle θswta1, if the arm tip height Zam exceeds the passage lower limit height Zamta1, the operation of the arm 9 is permitted, thereby allowing the loading operation to be performed more in accordance with the operator's intention.

The controller 40 may, in step S128, if it is determined that the current arm tip height Zam is greater than the passage lower limit height Zamta1, generate a correlation map Ma that sets the lower limit of the arm tip height to the passage lower limit height Zamta1, even if it is less than the interference prevention angle θswta1. In this configuration, if the arm tip height Zam exceeds the passage lower limit height Zamta1 before the swing angle θsw reaches the interference prevention angle θswta1, a boom raising operation is performed thereafter to prevent the arm tip height from falling below the passage lower limit height Zamta1 before the swing angle θsw reaches the interference prevention angle θswta1. Thus, even if the arm operation becomes effective before the swing angle θsw reaches the interference prevention angle θswta1, it prevents the arm tip height from falling below the passage lower limit height Zamta1. Therefore, it is possible to more appropriately prevent interference between the bed 201 and the bucket 10 during the loading operation.

Modification Example 4

Figure 24:
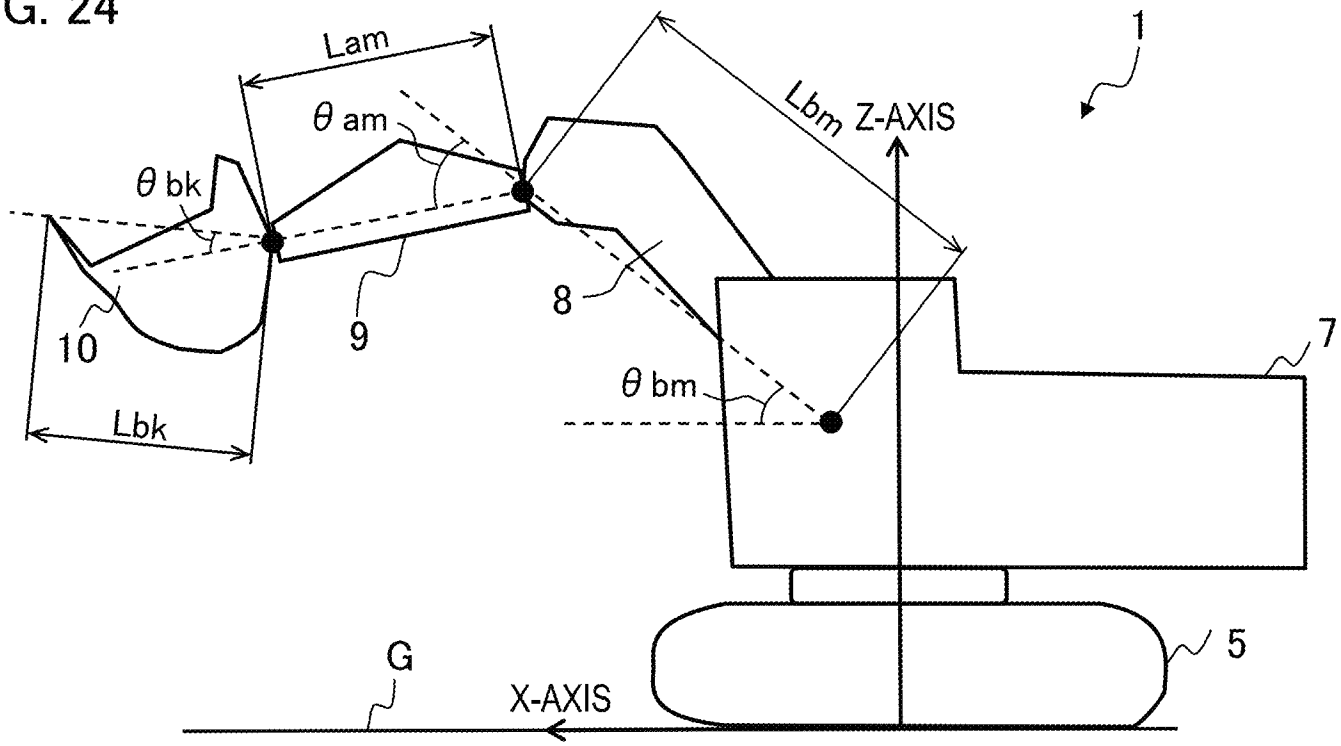
FIG. 24 is a side view of a hydraulic excavator according to modification example 4.

In the above embodiment, a backhoe excavator with the bucket 10 attached backward at the tip of the arm 9 was described as an example of a work machine, but the present invention is not limited to this. As shown in FIG. 24, the work machine may be a loading excavator with the bucket 10 attached forward at the tip of the arm 9.

Modification Example 5

In the above embodiment, an example was described in which a vessel position acquisition device for acquiring the relative position of the to-be-loaded machine 200's bed (vessel) 201 with respect to the hydraulic excavator 1 is an object position detection device 54, but the present invention is not limited to this.

The vessel position acquisition device may be configured to acquire the position information of the to-be-loaded machine 200's bed 201 at the construction site through a server such as an office via a communication device. The controller 40 may acquire the position coordinates (Xg, Yg, Zg) of the to-be-loaded machine 200's bed 201 in the global coordinate system via a communication device. The controller 40 may acquire the position coordinates (Xg, Yg, Zg) and orientation of the hydraulic excavator 1 in the global coordinate system from a positioning device including a GNSS (Global Navigation Satellite System) antenna attached to the hydraulic excavator 1. The controller 40 may convert the position coordinates of the bed 201 and the hydraulic excavator 1 in the global coordinate system into position coordinates (X, Y, Z) in the excavator reference coordinate system of the hydraulic excavator 1. In this modification example, an example was described in which the object position acquisition device acquires position coordinates based on the global coordinate system, but it may also acquire position coordinates based on a site-specific coordinate system (local coordinate system).

Modification Example 6

In the above embodiment, an example was described in which the operation system is an electric lever type operation system, but the present invention is not limited to this. Although not shown, the operation system may be a hydraulic pilot type operation system having a pressure reducing valve that generates operation pressure according to the operation amount and direction of operation levers 22, 23 by operation devices 20, 21.

Modification Example 7

As an example of combining the configurations described in the different embodiments above, a hydraulic excavator 1 capable of executing both the loading operation support control described in the first embodiment or the third embodiment and the preparation operation support control described in the second embodiment can be considered.

The controller 40 of the hydraulic excavator 1 according to this modification example determines whether a first interference prevention control execution condition, which includes a swing operation in which the bucket 10 approaches the right side part (first side part) 202*r* from outside the bed 201 in a plan view, has been met based on the relative position of the bed 201 to the hydraulic excavator 1 obtained by the object position detection device (vessel position acquisition device) 54. If the activation condition is met, the controller 40 enables the operation of the arm 9 by the operation device (arm operation device) 20. The controller 40 determines whether the bucket 10 has passed the right side part (first side part) 202*r* in a plan view after swinging beyond the interference prevention position. If it is not determined that the bucket 10 has passed the right side part (first side part) 202*r*, the controller 40 controls the operation of at least one of the boom 8 and the arm 9 so that the height of the tip of the arm 9 operating in response to the operation by the operation device (arm operation device) 20 does not fall below the interference prevention height Zamta1. If it is determined that the bucket 10 has passed the right side part (first side part) 202*r*, the controller 40 allows the operation of the tip of the arm 9 to a position lower than the interference prevention height Zamta1.

Furthermore, the controller 40 of the hydraulic excavator 1 according to this modification example determines whether a second interference prevention control execution condition, which includes a swing operation in which the bucket 10 approaches the right side part (first side part) 202*r* from inside the bed 201 in a plan view, has been met based on the relative position of the bed 201 to the hydraulic excavator 1 obtained by the object position detection device (vessel position acquisition device) 54. If the activation condition is met, the controller 40 enables the operation of the arm 9 by the operation device (arm operation device) 20. The controller 40 determines whether the bucket 10 has passed the right side part (first side part) 202*r* in a plan view. If it is not determined that the bucket 10 has passed the right side part (first side part) 202*r*, the controller 40 controls the operation of at least one of the boom 8 and the arm 9 so that the height of the tip of the arm 9 operating in response to the operation by the operation device (arm operation device) 20 does not fall below the interference prevention height Zamtb1. If it is determined that the bucket 10 has passed the right side part (first side part) 202*r*, the controller 40 allows the operation of the tip of the arm 9 to a position lower than the interference prevention height Zamtb1.

According to this configuration, when performing a series of operations such as excavating, loading, and preparation, the operation of the hydraulic excavator 1 is supported in a manner that prevents interference between the bed 201 and the bucket 10 while aligning with the operator's intentions. As a result, the efficiency of work performed by the hydraulic excavator 1 can be improved.

Modification Example 8

In the above embodiment, an example where the vessel into which the excavated material dug by the work device 2 is loaded is the bed 201 of a dump truck was described, but the present invention is not limited to this. The present invention may be applied to loading excavated material onto the bed (vessel) of an off-road haul vehicle equipped with a crawler-type track body. Furthermore, the present invention may be applied to loading excavated material onto a vessel placed on a belt conveyor. Although the embodiments of the present invention have been described above, these embodiments are merely examples of applications of the present invention and are not intended to limit the technical scope of the present invention to the specific configurations of these embodiments. It should be noted that the control lines and information lines shown in the figures are those considered necessary for explanation and do not necessarily represent all the control lines and information lines required on the product. It may be considered that almost all components are interconnected.

DESCRIPTION OF REFERENCE CHARACTERS

1 . . . Hydraulic excavator, 2 . . . Work device, 3 . . . Machine body, 4 . . . Travel hydraulic motor (hydraulic actuator), 5 . . . Lower track body (track body), 6 . . . Swing hydraulic motor (hydraulic actuator), 7 . . . Upper swing body (swing body), 8 . . . Boom, 8*a* . . . Boom pin, 9 . . . Arm, 9*a* . . . Arm pin, 10 . . . Bucket, 10*a* . . . Bucket pin, 11 . . . Boom cylinder, 12 . . . Arm cylinder, 13 . . . Bucket cylinder, 14 . . . Boom angle sensor (posture sensor), 15 . . . Arm angle sensor (posture sensor), 17 . . . Bucket angle sensor (posture sensor), 18 . . . Inclination angle sensor (posture sensor), 19 . . . Swing angle sensor (posture sensor), 20 . . . Operating device (arm operating device, swing operating device), 39 . . . Actuator control section, 40 . . . Controller, 41 . . . Posture calculation section, 42 . . . To-be-loaded machine position calculation section, 43 . . . Speed calculation section, 44 . . . Speed vector calculation section, 45 . . . Condition determination section, 46 . . . Target angle calculation section, 47 . . . Posture comparison section, 48 . . . Target speed calculation section, 49 . . . Correlation map generation section, 50 . . . Hydraulic drive system, 51 . . . Electromagnetic proportional valve, 52 . . . Operation amount sensor, 53 . . . Posture detection device, 54 . . . Object position detection device (vessel position acquisition device), 55 . . . Target object information acquisition device, 56 . . . Operation detection device, 90 . . . Assist control execution switch, 100 . . . Pilot line, 101 . . . Flow control valve, 102 . . . Main pump (hydraulic pump), 103 . . . Engine, 104 . . . Pilot pump (hydraulic pump), 200 . . . To-be-loaded machinery, 201 . . . Bed (vessel), 202 . . . Side part (first side part, second side part), 203 . . . Bottom part, Rta1 . . . Arm tip distance, Rta1*a* . . . Bucket tip distance, W . . . Weight, WO . . . Weight threshold, Zamata1, Zamtb1 . . . Passage minimum height (interference prevention height), Zamta2 . . . Inner-vessel minimum height (inner-vessel minimum value), γ . . . Ground angle, γt . . . Ground angle threshold, θam . . . Arm angle, θamsa1, θamsb1 . . . Control start arm angle, 8*bk* . . . Bucket angle, θbm . . . Boom angle, θbmta1, θbmtb1 . . . Passage minimum boom angle, θsw . . . Swing angle, θswsa1, θswsb1 . . . Control start swing angle, θswta . . . Lap swing angle, θswta0 . . . Reference prevention angle, θswta1 . . . Interference prevention angle, θswta2 . . . Inner-bed reach angle, θswta3 . . . Inner-bed limit angle, θswtb . . . Lap swing angle, θswtb1 . . . Interference prevention angle, θswtb2 . . . Outer-bed reach angle.

The invention claimed is:

1. A work machine comprising:

a track body;

a swing body provided so as to be able to swing relative to the track body;

a work device attached to the swing body and having a boom, an arm, and a bucket;

a posture detection device for detecting a posture of the work device;

a vessel position acquisition device for acquiring a position of a vessel of a to-be-loaded machine, into which excavated material excavated by the work device is loaded;

an arm operation device for operating the arm;

a swing operation device for operating the swing body; and a controller for controlling an operation of the work device and the swing body, the work machine being configured to load an object excavated into the vessel having a bottom and a plurality of side parts with an open top, wherein the controller is configured to:

calculate a height of a tip of the arm at which the work device does not interfere with the vessel as an interference prevention height based on the position of the vessel acquired by the vessel position acquisition device;

determine whether an interference prevention control execution condition, including a swing operation towards the direction in which the bucket approaches the side part of the vessel, is met;

when it is determined that the interference prevention control execution condition is met, identify an operation start position, which is a circumferential position of the tip of the arm when the interference prevention control execution condition is met, based on the posture of the work device detected by the posture detection device, and identify an interference prevention position, which is an angular position in a swing direction of the tip of the arm that does not interfere between the vessel and the work device, from the operation start position to the side part of the vessel;

calculate a lower limit of a height direction of the work device corresponding to the angular position in the swing direction of the tip of the arm, which becomes larger as it approaches the interference prevention position and reaches the interference prevention height at the interference prevention position, within an operating range of the swing body from the identified operation start position to the interference prevention position;

disable the operation of the arm by the arm operation device and control the operation of the boom and the swing body so that the height of the tip of the arm does not fall below the lower limit, during the operation of the swing body from the operation start position to the interference prevention position;

determine whether an activation condition for the operation of the arm, including reaching the angular position in the swing direction beyond the interference prevention position while the tip of the arm is at a height exceeding the interference prevention height, is met;

enable the operation of the arm by the arm operation device if the activation condition is met;

determine whether the bucket has passed through the side part of the vessel in a plan view after swinging beyond the interference prevention position;

control the operation of at least one of the boom and the arm so that the height of the tip of the arm operated in accordance with the operation of the arm operation device does not fall below the interference prevention height if it is not determined that the bucket has passed through the side part of the vessel; and allow the operation of the tip of the arm to a position lower than the interference prevention height if it is determined that the bucket has passed through the side part of the vessel.

2. The work machine according to claim 1, wherein the interference prevention control execution condition includes that the posture of the work device is a hauling posture, and the controller is configured to determine whether the posture of the work device is the hauling posture based on the detection result of the posture detection device.

3. The work machine according to claim 1, comprising:

an object information acquisition device configured to acquire information of a to-be-hauled object within the bucket, wherein the interference prevention control execution condition includes a presence of the to-be-hauled object within the bucket, and the controller is configured to determine whether the to-be-hauled object exists within the bucket based on the information of the to-be-hauled object within the bucket acquired by the object information acquisition device.

4. The work machine according to claim 1, wherein the vessel has a first side part and a second side part as a pair of the side parts arranged to face each other, the vessel position acquisition device is configured to acquire a relative position of the vessel to the work machine, and the controller is configured to:

determine whether the interference prevention control execution condition, which includes a swing operation in a direction such that the bucket approaches the first side part from outside of the vessel in a plan view, has been met based on the relative position of the vessel to the work machine acquired by the vessel position acquisition device;

enable operation of the arm by the arm operation device if the activation condition is met;

determine whether the bucket has passed through the first side part in a plan view after swinging beyond the interference prevention position;

control at least one of the operation of the boom and the arm so that the height of the tip of the arm operated in response to the operation of the arm by the arm operation device does not fall below the interference prevention height if it is not determined that the bucket has passed through the first side part;

allow the operation of the tip of the arm to a lower position than the interference prevention height if it is determined that the bucket has passed through the first side part;

set an inner-vessel lower limit value for the height position of the tip of the arm where the bottom and the bucket do not contact between the first side part and the second side part; and control at least one of the operation of the boom and the arm so that the height of the tip of the arm does not fall below the inner-vessel lower limit value when the bucket is moving between the first side part and the second side part within the vessel.

5. The work machine according to claim 4, wherein the controller is configured to:

determine whether the interference prevention control execution condition, which includes a swing operation in a direction such that the bucket approaches the first side part from inside of the vessel in a plan view, has been met based on the relative position of the vessel to the work machine acquired by the vessel position acquisition device;

enable operation of the arm by the arm operation device if the activation condition is met;

determine whether the bucket has passed through the first side part in a plan view;

control at least one of the operation of the boom and the arm so that the height of the tip of the arm operated in response to the operation of the arm by the arm operation device does not fall below the interference prevention height if it is not determined that the bucket has passed through the first side part; and allow the operation of the tip of the arm to a lower position than the interference prevention height if it is determined that the bucket has passed through the first side part.

* * * * *